US012109465B2

(12) United States Patent
Yi et al.

(10) Patent No.: US 12,109,465 B2
(45) **Date of Patent: *Oct. 8, 2024**

(54) GOLF CLUB HEAD WITH HOSEL HOLE COVER

(71) Applicant: Acushnet Company, Fairhaven, MA (US)

(72) Inventors: Sang Yi, Carlsbad, CA (US); Stephen S. Murphy, Carlsbad, CA (US); Richard L. Cleghorn, Oceanside, CA (US); Richard Sanchez, Temecula, CA (US)

(73) Assignee: Acushnet Company, Fairhaven, MA (US)

( * ) Notice: Subject to any disclaimer, the term of this patent is extended or adjusted under 35 U.S.C. 154(b) by 10 days.

This patent is subject to a terminal disclaimer.

(21) Appl. No.: 18/176,125

(22) Filed: Feb. 28, 2023

(65) Prior Publication Data

US 2023/0201681 A1 Jun. 29, 2023

Related U.S. Application Data

(63) Continuation of application No. 17/196,676, filed on Mar. 9, 2021, now Pat. No. 11,617,926.

(51) Int. Cl.

| | |
|---|---|
| ***A63B 53/02*** | (2015.01) |
| ***A63B 53/04*** | (2015.01) |
| ***A63B 53/06*** | (2015.01) |
| *A63B 102/32* | (2015.01) |

(52) U.S. Cl.
CPC ..... *A63B 53/06* (2013.01); *A63B 53/023* (2020.08); *A63B 2053/0491* (2013.01); *A63B 2102/32* (2015.10)

(58) Field of Classification Search
CPC ..... A63B 53/02; A63B 53/04
See application file for complete search history.

(56) References Cited

U.S. PATENT DOCUMENTS

| | | | |
|---|---|---|---|
| 4,754,974 | A | 7/1988 | Kobayashi |
| 5,127,653 | A | 7/1992 | Nelson |
| 5,366,223 | A | 11/1994 | Werner et al. |
| 5,722,901 | A | 3/1998 | Barron |
| 5,971,868 | A | 10/1999 | Kosmatka |
| 6,089,991 | A | 7/2000 | Yeh |
| 6,319,150 | B1 | 11/2001 | Werner et al. |

(Continued)

FOREIGN PATENT DOCUMENTS

| | | | |
|---|---|---|---|
| EP | 3342469 | A1 | 7/2018 |
| GB | 2403425 | A | 1/2005 |

(Continued)

*Primary Examiner* — Alvin A Hunter
(74) *Attorney, Agent, or Firm* — Randy K. Chang

(57) ABSTRACT

A golf club head with a hosel hole cover that helps improve the performance of the golf club head is disclosed. More specifically, the present invention relates to a golf club head having a hosel hole cover at a bottom portion of an interchangeable connection system that not only provides improved performance of the golf club head by strategically utilizing an existing opening to adjust the weighting of a golf club head, but it also improves the aerodynamics of the golf club head by eliminating undesirable recesses that could be detrimental to the aerodynamics of a golf club head.

18 Claims, 35 Drawing Sheets

(56) References Cited

U.S. PATENT DOCUMENTS

| | | | |
|---|---|---|---|
| 6,368,230 | B1 | 4/2002 | Helmstetter |
| 6,368,234 | B1 | 4/2002 | Galloway |
| 6,402,637 | B1 | 6/2002 | Sasamoto et al. |
| 6,428,426 | B1 | 8/2002 | Helmstetter et al. |
| 6,428,427 | B1 | 8/2002 | Kosmatka |
| 6,475,100 | B1 | 11/2002 | Helmstetter |
| 6,506,127 | B2 | 1/2003 | Helmstetter et al. |
| 6,508,722 | B1 | 1/2003 | McCabe et al. |
| 6,558,272 | B2 | 5/2003 | Helmstetter et al. |
| 6,623,377 | B2 | 9/2003 | Evans et al. |
| 6,652,391 | B1 | 11/2003 | Kubica et al. |
| 6,776,726 | B2 | 8/2004 | Sano |
| 6,800,040 | B2 | 10/2004 | Galloway et al. |
| 6,863,626 | B2 | 3/2005 | Evans et al. |
| 6,899,638 | B2 | 5/2005 | Iwata et al. |
| 6,997,820 | B2 | 2/2006 | Willett et al. |
| 7,014,570 | B2 | 3/2006 | Evans et al. |
| 7,101,289 | B2 | 9/2006 | Gibbs et al. |
| 7,137,907 | B2 | 11/2006 | Gibbs et al. |
| 7,147,575 | B2 | 12/2006 | Galloway et al. |
| 7,169,059 | B2 | 1/2007 | Rice et al. |
| 7,220,190 | B2 | 5/2007 | Hirano |
| 7,258,626 | B2 | 8/2007 | Gibbs et al. |
| 7,273,421 | B2 | 9/2007 | Knuth |
| 7,278,927 | B2 | 10/2007 | Gibbs et al. |
| 7,338,388 | B2 | 3/2008 | Schweigert et al. |
| 7,347,794 | B2 | 3/2008 | Schweigert |
| 7,364,513 | B2 | 4/2008 | Krumme |
| 7,407,448 | B2 | 8/2008 | Stevens et al. |
| 7,431,664 | B2 | 10/2008 | Meyer et al. |
| 7,442,132 | B2 | 10/2008 | Nishio |
| 7,549,934 | B2 | 6/2009 | Rice |
| 7,584,531 | B2 | 9/2009 | Schweigert et al. |
| 7,651,412 | B2 | 1/2010 | Meyer et al. |
| 7,749,096 | B2 | 7/2010 | Gibbs et al. |
| 7,762,907 | B2 | 7/2010 | Rice |
| 7,887,431 | B2 | 2/2011 | Beach |
| 8,272,975 | B2 | 9/2012 | Morin et al. |
| 8,303,432 | B2 | 11/2012 | Curtis et al. |
| 8,562,458 | B2 | 10/2013 | Morin et al. |
| 8,715,104 | B1 | 5/2014 | Wall, Jr. |
| 8,753,221 | B1 | 6/2014 | Aguinaldo |
| 8,784,233 | B2 | 7/2014 | Morin et al. |
| 10,010,768 | B2 | 7/2018 | Mizutani |
| 10,076,691 | B1 | 9/2018 | Kingston |
| 10,596,421 | B1 | 3/2020 | Myers |
| 10,668,336 | B2 | 6/2020 | Kingston |
| 10,814,189 | B1 | 10/2020 | Myers |
| 11,433,285 | B1 * | 9/2022 | Yi ..... A63B 53/02 |
| 11,617,926 | B2 * | 4/2023 | Yi ..... A63B 53/023 473/305 |
| 2002/0137575 | A1 | 9/2002 | Tseng |
| 2008/0254908 | A1 | 10/2008 | Bennett |
| 2015/0038253 | A1 | 2/2015 | Mizutani |
| 2017/0291078 | A1 | 10/2017 | Higdon |
| 2018/0028876 | A1 | 2/2018 | Jacaman |
| 2018/0185710 | A1 | 7/2018 | Mizutani |
| 2018/0229087 | A1 | 8/2018 | Amundsen |
| 2018/0345088 | A1 | 12/2018 | Onuki |
| 2019/0168085 | A1 | 6/2019 | Kingston |
| 2021/0038951 | A1 | 2/2021 | Myers |
| 2021/0086040 | A1 | 3/2021 | Kingston |
| 2022/0288471 | A1 * | 9/2022 | Yi ..... A63B 53/0445 |

FOREIGN PATENT DOCUMENTS

| | | |
|---|---|---|
| JP | 2003135630 | 5/2003 |
| JP | 2005143601 | 6/2005 |
| JP | 2010051707 | 3/2010 |
| JP | 2011125723 | 6/2011 |
| JP | 2020044128 | 3/2020 |
| KR | 20150092171 A | 8/2015 |
| WO | WO 2011121650 A1 | 10/2011 |
| WO | 2015056643 | 4/2015 |

* cited by examiner

GOLF CLUB HEAD WITH HOSEL HOLE COVER

CROSS-REFERENCE TO RELATED APPLICATIONS

The present application is a Continuation (CON) of U.S. patent application Ser. No. 17/196,676, filed Mar. 9, 2021, the disclosure of which is incorporated by reference in its entirety.

FIELD OF THE INVENTION

The present invention relates generally to a golf club head with a hosel hole cover that helps improve the performance of the golf club head. More specifically, the present invention relates to a golf club head having a hosel hole cover at a bottom portion of an interchangeable connection system that not only provides improved performance of the golf club head by strategically utilizing an existing opening to adjust the weighting of a golf club head, but it also improves the aerodynamics of the golf club head by eliminating undesirable recesses that could be detrimental to the aerodynamics of a golf club head.

BACKGROUND OF THE INVENTION

Improving the aerodynamics of a golf club head has always been one of the ways golf club designers attempt to improve the performance of a golf club head. U.S. Pat. No. 4,754,974 to Kobayashi back in 1987 illustrated one of the earliest attempts to improve the performance of a golf club head by focusing on the aerodynamics. Kobayashi attempts to create a surface structure on a golf club head to produce a turbulent boundary layer in the air on the outer surface of the head body.

Although the aerodynamics of a golf club head may be a crucial component in it's overall performance, there are numerous other factors that also helps contribute to improving the overall performance of a golf club head; some of which could even come with some detriment to the aerodynamics of the golf club head. U.S. Pat. No. 6,368,230 to Helmstetter et al. filed in 2000 illustrates one of these innovations as it relates to a golf club that creates a removable hosel system, allowing the club and shaft to be releasably attached to one another. This invention not only made it significantly easier for golfers to try different club and head combinations in their golf club, it also paved the way for subsequent technological advancements in the industry relating to golf club adjustability.

U.S. Pat. No. 7,887,431 to Beach et al., filed in 2008 illustrates further improvements upon the previously discussed invention by creating a releasable shaft system that is also capable of altering the loft and/or lie angle of the golf club head without resorting to traditional bending of the shaft.

However, both the Helmstetter et al. and Beach et al. invention requires access to the golf club from the bottom of the sole into the hosel portion via a sole attachment opening, which could adversely affect the aerodynamics of the golf club head. In addition to the above, this attachment opening that is required to facilitate the interchangeability of the shaft hosel system can also be leveraged to manipulate the center of gravity (CG) of the golf club head by installing a weighting member in this attachment opening.

U.S. Pat. No. 10,668,336 to Kingston illustrates an attempt to take advantage of the attachment opening to help manipulate the weighting of the golf club head. More specifically, Kingston teaches a weight plug sized to fit within, and at least partially fill, the heel-side attachment opening. Kingston although capable of utilizing this existing attachment opening for weighting purposes, does so via a complicated system requiring multiple components, often requiring multiple threads that make is complicated to install and uninstall. Moreover, Kingston fails to recognize the ability to improve the aerodynamics of the golf club head by addressing the negative effects of the attachment opening on the aerodynamics of the golf club head.

Hence, based on the above, it can be seen that there is a need in the art for an improved hosel hole cover that can easily adjust the weighting and CG of the golf club head all while improving the aerodynamics of the golf club head.

BRIEF SUMMARY OF THE INVENTION

One aspect of the present invention is a golf club head comprising of a body portion, further comprising of a crown portion, a sole portion, a heel portion, and a toe portion. The golf club head has a hosel region located near a heel portion of the golf club head, wherein the hosel region further comprises of an upper end having a releasable hosel mechanism, a lower end having a hosel hole, a hosel hoe cover, and a retention mechanism. The hosel hole itself further comprises of one or more non-threaded recessed undercuts along a side wall of the hosel hole. The hosel hole cover is adapted to substantially cover the entirety of an internal surface of the hosel hole. The retention mechanism is adapted to secure the hosel hole cover to the golf club head, wherein the retention mechanism further comprises of one or more non-threaded protrusions. The one or more non-threaded protrusions are adapted to engage the one or more non-threaded recessed undercuts to secure the hosel hole cover to the golf club head.

In another aspect of the present invention is a golf club head comprising of a body portion, further comprising of a crown portion, a sole portion, a heel portion, and a toe portion. The golf club head has a hosel region located near a heel portion of the golf club head, wherein the hosel region further comprises of an upper end having a releasable hosel mechanism, a lower end having a hosel hole, and a hosel hole cover. The hosel hole cover is adapted to substantially cover the entirety of an external surface of the hosel hole, and the hosel hole cover further comprises a receptacle opening, wherein the receptacle opening has a surface area of between about 55 $mm^2$ to about 300 $mm^2$.

In another aspect of the present invention is a golf club head comprising of a body portion, further comprising of a crown portion, a sole portion, a heel portion, and a toe portion. The golf club head has a hosel region located near a heel portion of the golf club head, wherein the hosel region further comprises of an upper end having a releasable hosel mechanism, a lower end having a hosel hole, a hosel hoe cover, and a retention mechanism. The hosel hole itself further comprises of one or more non-threaded recessed undercuts along a side wall of the hosel hole. The hosel hole cover is adapted to substantially cover the entirety of an internal surface of the hosel hole. The retention mechanism is adapted to secure the hosel hole cover to the golf club head, wherein the retention mechanism further comprises of one or more non-threaded protrusions. The one or more non-threaded protrusions are adapted to engage the one or more non-threaded recessed undercuts to secure the hosel hole cover to the golf club head. The hosel hole cover further comprises a receptacle opening, adapted to receive the retention mechanism, the receptacle opening has a surface area of between about 55 $mm^2$ to about 300 $mm^2$. The engagement member is only adapted to rotate 90 degrees.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below, and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
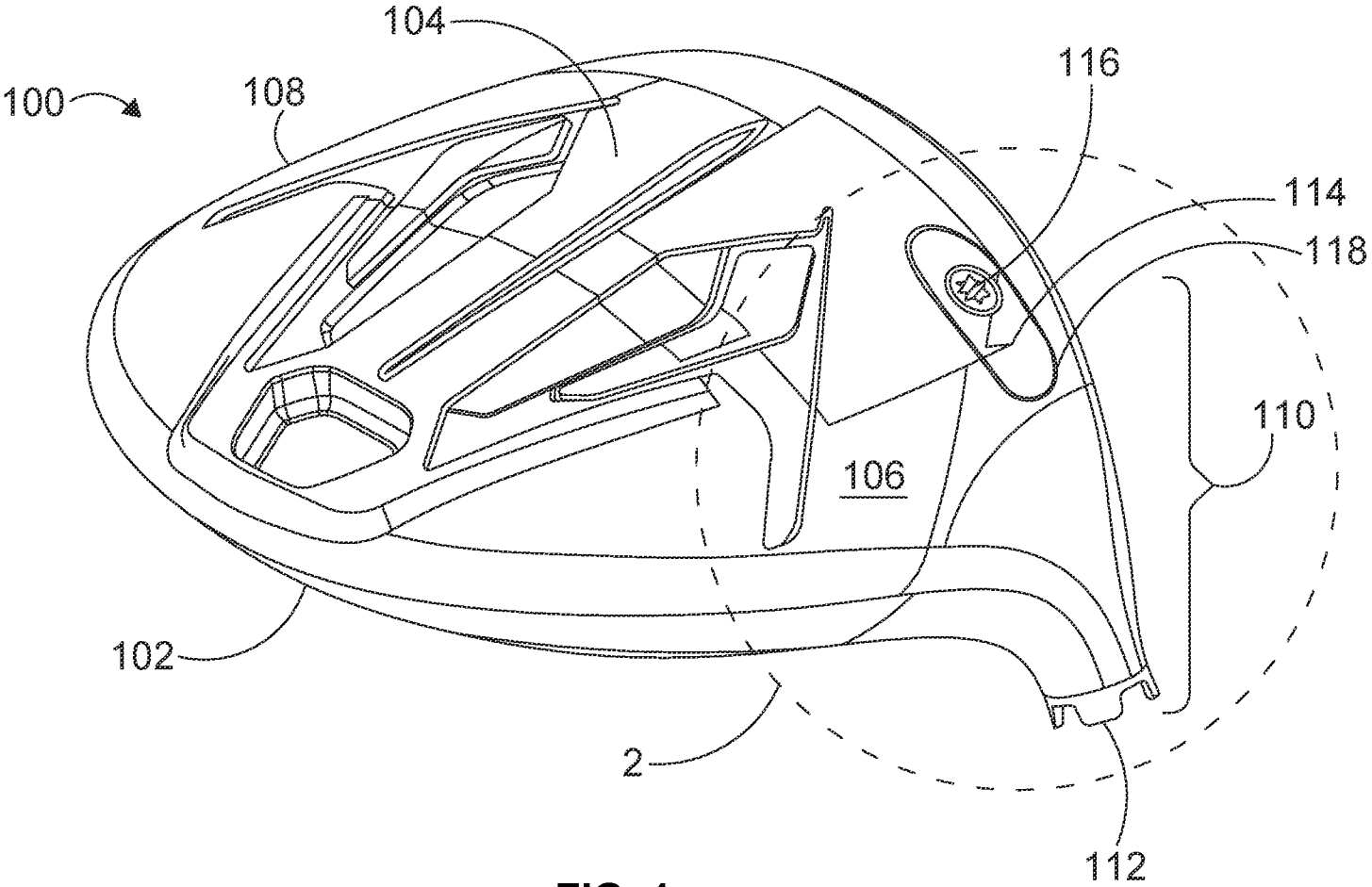
FIG. 1 of the accompanying drawings shows a bottom sole side perspective view of a golf club head in accordance with an exemplary embodiment of the present invention.

FIG. 1 of the accompanying drawings shows a perspective sole view of a golf club head 100 in accordance with an exemplary embodiment of the present invention showing the golf club head 100 in an upside down orientation. The golf club head 100 is further comprised of a crown portion 102 (shown as the underside in FIG. 1), the sole portion 104, a heel portion 106, and a toe portion 108. The golf club head 100 in accordance with the present invention may generally have a hosel region 110 located the heel portion 106 of the golf club head 100. At the upper end of the hosel region 110 is a releasable hosel mechanism 112 that allows the golf club head 100 to be releasably attached to different shafts using an attachment screw (not shown), sometimes even allowing for adjustments to the loft, lie, and face angle of the golf club head, all without departing from the scope and content of the present invention. More information relating to the technology behind the releasable hosel mechanism 112 can be found in commonly owned U.S. Pat. No. 10,272,298 to Zimmerman et al., the disclosure of which is incorporated by reference in its entirety. Additionally. FIG. 1 of the accompanying drawings shows the hosel hole cover 114 with a retention mechanism 116 adapted to cover up the entirety of an internal surface of the hosel hole 118, located at a lower end of the hosel region 110 opposite the releasable hosel mechanism 112. Finally, FIG. 1 of the accompanying drawings also highlight a circular region 2, to which an enlarged view of the hosel region 110 of the golf club head 100 may be shown in more detail.

Figure 2:
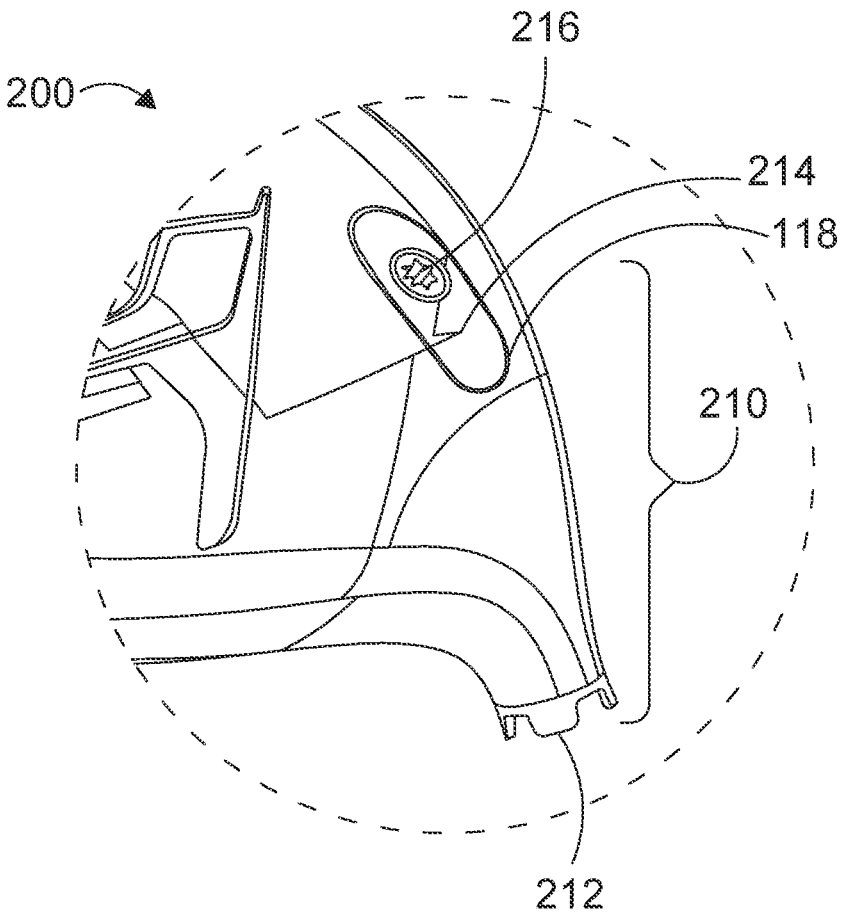
FIG. 2 of the accompanying drawings shows an enlarged view of a hosel region of a golf club head as shown by circular region 2 shown in FIG. 1.

FIG. 2 of the accompanying drawings shows an enlarged view of the hosel region 210 of a golf club head 200 in accordance with an exemplary embodiment of the present invention as highlighted by circular region 2 shown in FIG. 1. In this enlarged view, we can see that the hosel hole cover 214 has a substantially oval shape that matches the external surface of the hosel hole 218 that is also oval shaped, and the same hosel hole cover 214 is attached to the golf club head 200 via a retention mechanism 216 shown here. The retention mechanism 216, although appearing as a mere screw head in FIG. 2, in actually an advanced attachment mechanism that is aimed at reducing the complexity of installing and removing the hosel hole cover 214 from the hosel hole 218. In order to illustrate the relationship between the various components, and the mechanism of retention, FIG. 3 of the accompanying drawings is provided below.

Figure 3:
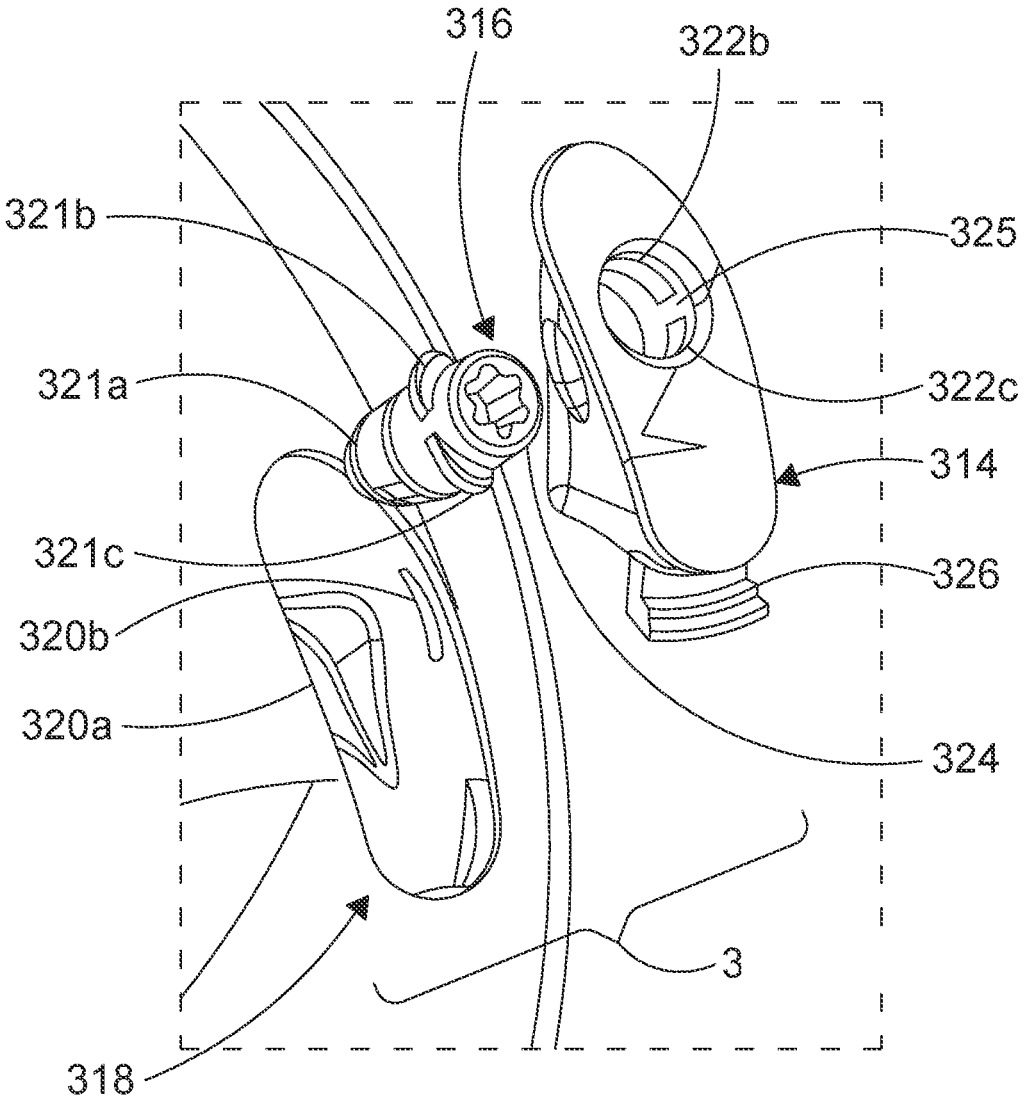
FIG. 3 of the accompanying drawings shows an exploded perspective view of a hosel region of a golf club head in accordance with an embodiment of the present invention.

FIG. 3 of the accompanying drawings shows an exploded view of the hosel region 310 in accordance with an exemplary embodiment of the present invention. This exploded view of the hosel region 310 shows how the three major components, the hosel hole 318, the hosel hole cover 314, and the retention mechanism 316, fit together. Referring to the hosel hole 318 shown in this exploded view in FIG. 3, we can see that the hosel hole 318 further comprises of one or more non-threaded recessed undercuts 320*a* and 320*b* that is formed along a side wall of the hosel hole 318. A first non-threaded recessed undercut 320*a* is formed towards the rear inside surface of the hosel hole 318, and adapted to engage a first non-threaded protrusion 321*a* via an attachment opening (not shown in this view) in the rear portion of the hosel hole cover 314. A second non-threaded recessed undercut 320*b*, is formed towards one of the side walls of the hosel hole 318 that is 90 degrees offset from the first non-threaded recessed undercut 320*a*, and is adapted to engage a second non-threaded protrusion 321*b* via a second attachment opening 322*b* in the hosel hole cover 314. A third non-threaded recess undercut (not shown here in this view, but is 180 offset from the second recessed undercut 320*b* and 90 degrees offset from the first threaded recessed undercut 320*a* in the opposite direction as the second recessed undercut 320*b*) is adapted to engage a third non-threaded protrusion 320*c* via a third attachment opening 322*c* in the hosel cover 314.

In addition to the above, FIG. 3 of the accompanying drawings also shows a male ledge 326 at the bottom of the hosel hole cover 314 the engages a corresponding female ledge (not shown in FIG. 3) at the bottom of the hosel hole 318 to further provide structural stability to the hosel hole cover 314 for it to be securely installed in the hosel hole 318.

A careful analysis of the relationship above makes clear the relationship between the three components hosel hole 318, hosel hole cover 314, and the retention mechanism 316 more clear. In summary, the present invention provides a unique non-threaded retention mechanism for securing the hosel hole cover 314 to the hosel hole 318 by first engaging the male ledge 326 with the female ledge. Once the hosel hole cover 314 has achieved its desired location within the hosel hole 318, the retention mechanism 316 is inserted through a receptacle opening 325 in the hosel hole cover 314. The receptacle opening 325 is shaped in a way to receive the retention mechanism 316 that forces the orientation of the retention mechanism 316 to a specific starting orientation to initiate the install. This rotation is generally a 90 degree rotation during the insertion process. Once the hole cover 314 receives the retention mechanism 316, a 180 degree rotation will allow the main non-threaded protrusion 321*a* to protrude out of an attachment opening 322*a* (not shown in FIG. 3) to engage the main non-threaded recessed undercut 320*a*. The other secondary protrusions 321*b*, and 321*c*, although capable of engaging corresponding non-threaded recessed undercuts 320*b* and 320*c* via openings 322*b*, and 322*b* to provide additional points of engagement for the hosel hole cover 314 into the hosel hole 318, it is not necessary. In fact, in the preferred alternative embodiment of the present invention, the secondary protrusions 321*b* and 321*c* only engage the openings 322*b* and 322*c* only as a means to secure the retention mechanism 316 to the hosel hole cover 314. It should be noted that it is critical to recognize here that the retention mechanism 316 is only adapted to rotate 180 degrees from its unlocked position towards its locked position. This feature is critical to the proper function of the present invention because it dramatically reduces the complexity of the installation and removal of the hosel hole cover 314 compared to a traditional threaded screw, which is important to the end user. The rotation of the retention mechanism 316 is generally accomplished via a six point star-shaped hexalobular pattern screw head 342, however, numerous other types of rotating screw mechanism may be used without departing from the scope and content of the present invention so long as it is able to provide a rotational force to the retention mechanism 316.

Before moving onto cross-sectional views of the present invention, it is worthwhile to discuss the aerodynamic benefits of the present invention. The aerodynamics of golf clubs have always been as area of interest for golf club designers, and voids in the bottom of the sole of the golf club head can generally alter the aerodynamic properties of the golf club head. Hence is it worth noting here that the shape and design of the hosel hole cover 314 is absolutely critical to the aerodynamic performance of the golf club head, and thus critical to the present invention that aims to improve the overall performance of the golf club head. The present invention, recognizing that the hosel hole 318 could greatly affect the aerodynamic performance of the golf club head, has found that an oversized hosel hole 318 is detrimental to the aerodynamic performance of the golf club head by reducing it's ability to achieve maximum clubhead speed. However, the on the flip side, the current research has also showed that too smooth of a sole, with little to no holes or openings into the sole is incapable of tripping the boundary layer of flow around the golf club head, which ironically also reduces clubhead speed. Hence, in order to maximize the aerodynamics of the current design of a golf club head, the current invention, the hosel hole cover 314 incorporates a receptacle opening 325 that has a surface area that is neither too large nor too small. More specifically, it can be said that the receptacle opening 325 in accordance with the present invention, may generally have a surface area between about 55 $mm^2$ to about 300 $mm^2$, more specifically between about 65 $mm^2$ to about 200 $mm^2$, and most preferably about 90 $mm^2$.

Figure 4:
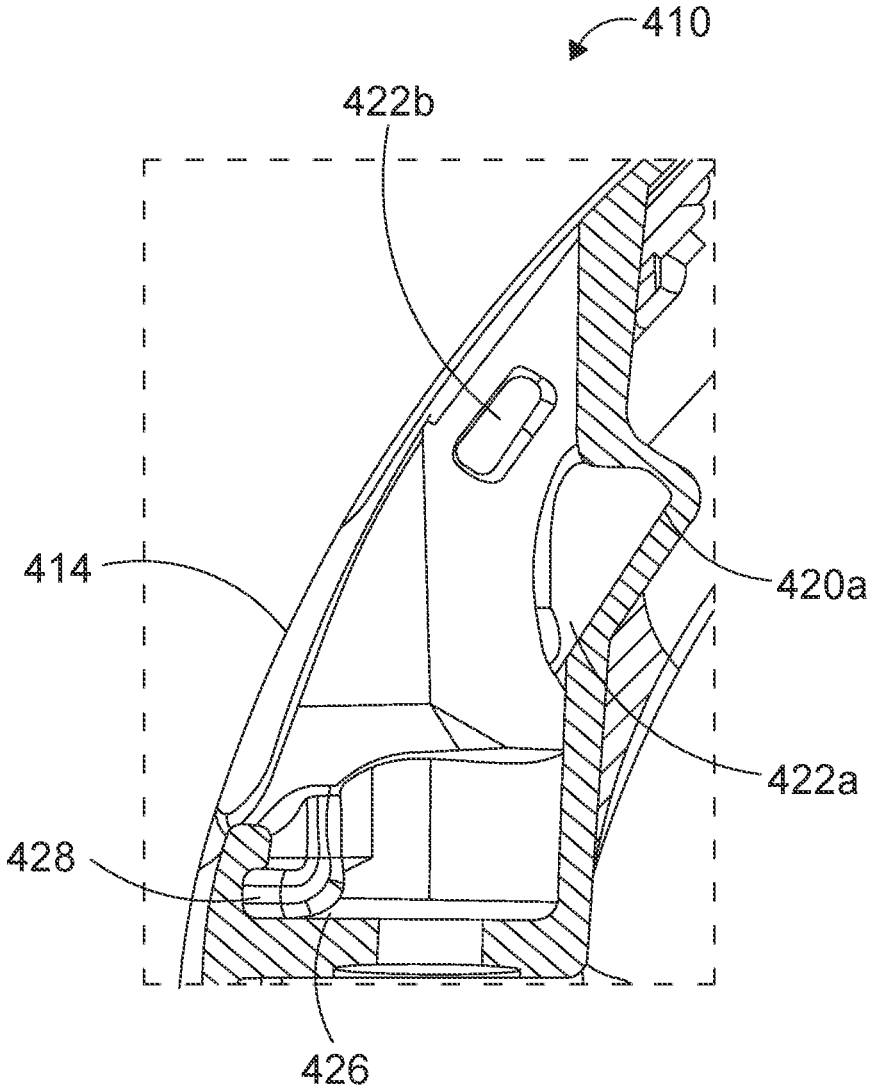
FIG. 4 of the accompanying drawings shows a partial cross-sectional view of a hosel region of a golf club head wherein the hosel hole cover is in an unlocked position in accordance with an embodiment of the present invention.

FIG. 4 of the accompanying drawings shows a partial cross-sectional view of a hosel region 410 of a golf club head in accordance with an exemplary embodiment of the present invention in the starting or unlocked orientation, as previously described. As you can see in this partial cross-sectional view, none of the non-threaded protrusions previously discussed are visible, because they have not been rotated to engage the non-threaded recessed undercuts. In this partial cross-sectional view, the first attachment opening 422*a* is shown for the first time to be an attachment opening at the rear surface of the hosel hole cover 414, placed directly adjacent to the first non-threaded recessed undercut 420*a*. In addition to the above, this partial cross-sectional view of the hosel region 410 shown in FIG. 4 is also capable of illustrating the relationship between the male ledge 426 and the female ledge 428, both of which have previously been explained as the initial alignment of the hosel hole cover 414 with the hosel hole.

Figure 5:
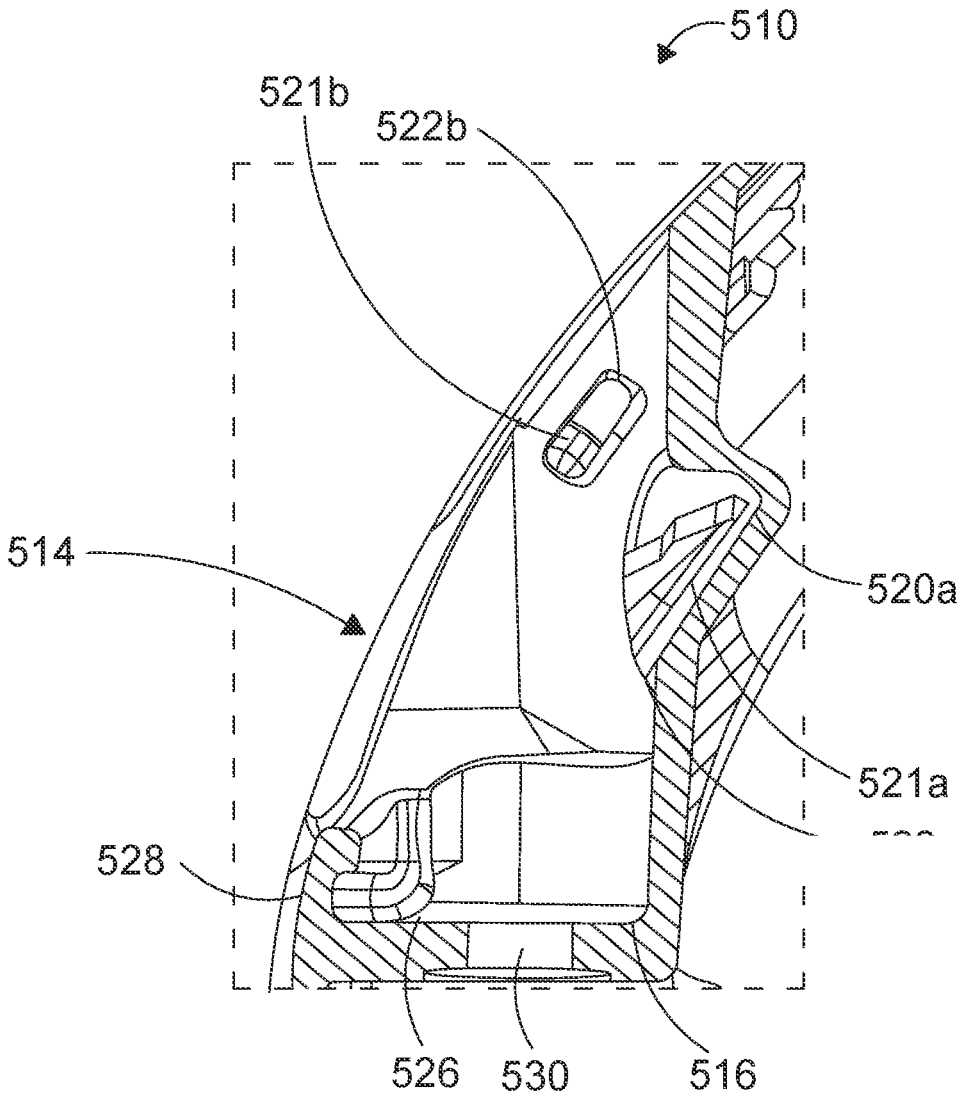
FIG. 5 of the accompanying drawings shows a partial cross-sectional view of a hosel region of a golf club head wherein the hosel hole cover is in a locked position in accordance with an embodiment of the present invention.

FIG. 5 of the accompanying drawings is more interesting, as it shows a partial cross-sectional view of a hosel region 510 of a golf club head in accordance with an exemplary embodiment of the present invention in the installed or locked orientation. In this view, it can be seen that the first non-threaded protrusion 521*a* is now rotated into an orientation to allow it to protrude out from the first attachment opening 522*a*, to engage the first non-threaded recessed undercut 520*a*. This engagement of the first non-threaded protrusion 512*a* with the first non-threaded recessed undercut 520*a* secures the hosel cover 514 to the hosel hole 518 near the hosel region 510. FIG. 5 also shows how additional attachment openings could work in conjunction with the first attachment opening 522*a* to help further secure the hosel cover 514 to the hosel hole 518. Although the present embodiment of the present invention incorporates three sets of protrusions, attachment openings, and recessed undercuts, any other number of sets of these may be used, including but not limited to one set, two sets, three sets, four sets, or any number of sets all without departing from the scope and content of the present invention.

Another feature to note in the partial cross-sectional views of the hosel region 510 is that the retention mechanism used to secure the hosel hole cover 514 to the golf club head is completely different from the threaded screw 530 that holds the golf club head itself to the shaft itself within the releasable hosel mechanism. As previously discussed, more information regarding the releasable hosel mechanism may be found in the commonly owned U.S. Pat. No. 10,272,298 to Zimmerman et al., the disclosure of which is once again incorporated by reference in its entirety.

Figure 6A:
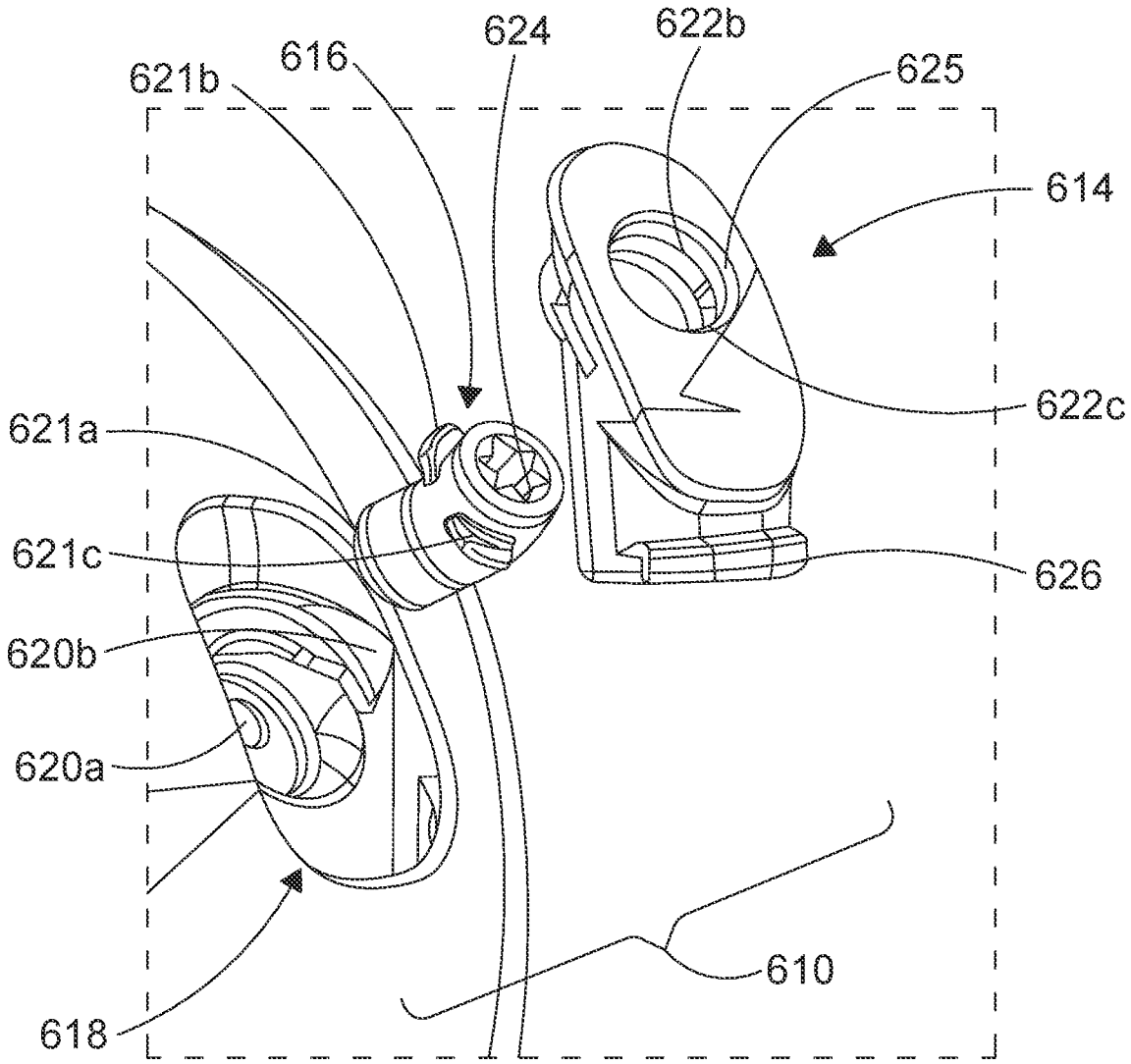
FIG. 6*a* of the accompanying drawings shows an exploded perspective view of a hosel region of a golf club head in accordance with an alternative embodiment of the present invention.
Figure 6B:
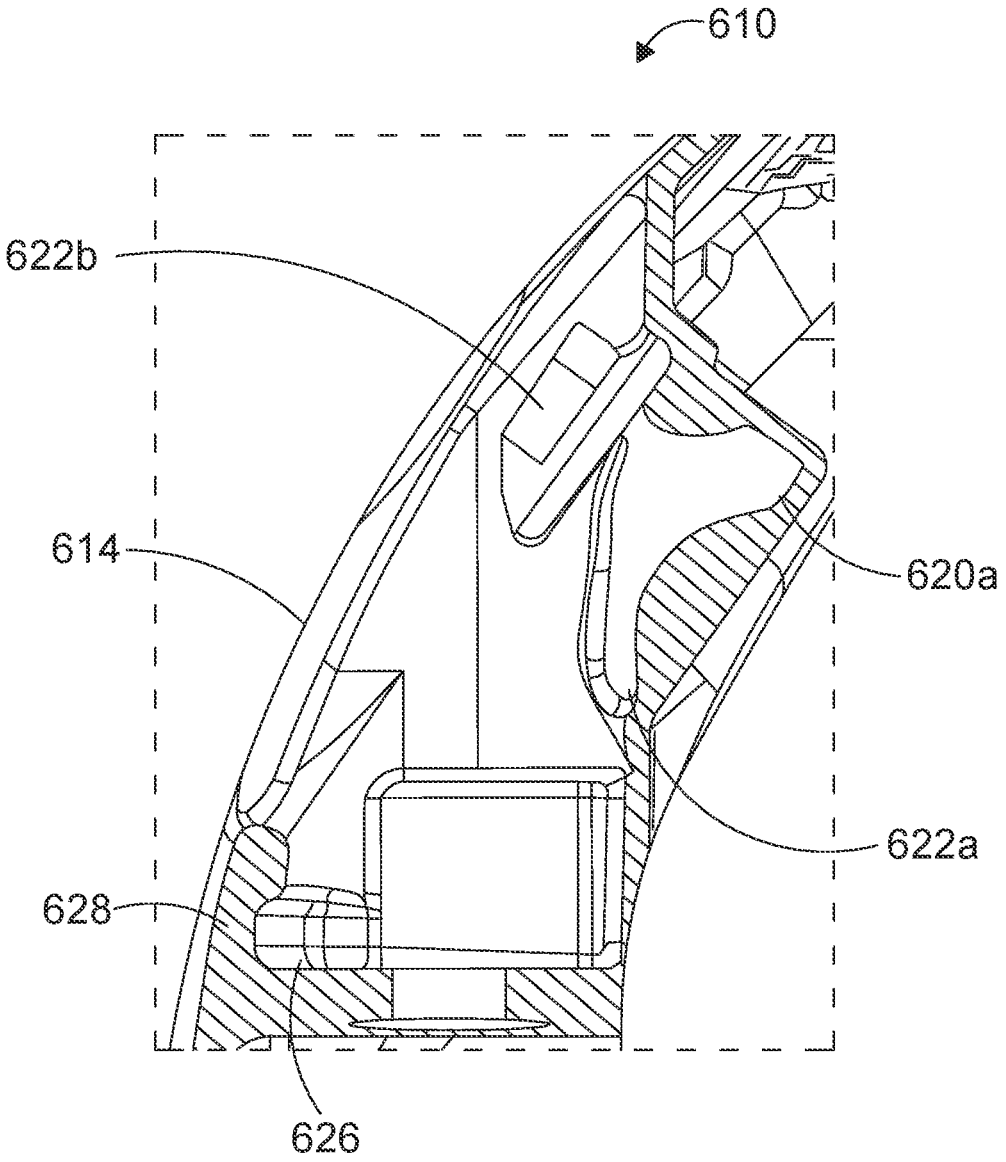
FIG. 6*b* of the accompanying drawings shows a partial cross-sectional view of a hosel region of a golf club head where the hosel hole cover is in an unlocked position in accordance with an alternative embodiment of the present invention.
Figure 6C:
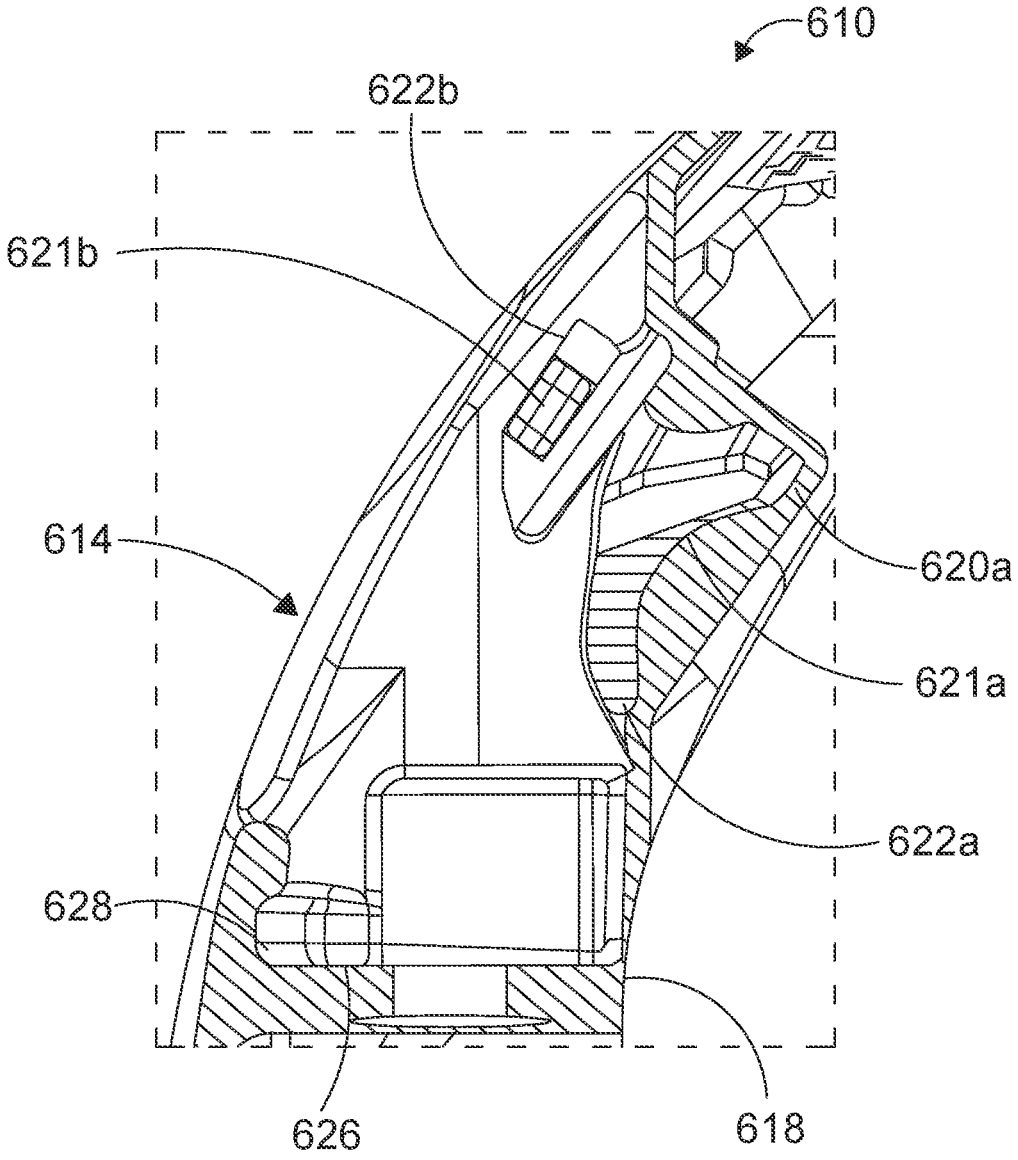
FIG. 6*c* of the accompanying drawings shows a partial cross-sectional view of a hosel region of a golf club head wherein the hosel hole cover is in a locked position in accordance with an alternative embodiment of the present invention.

FIGS. 6*a* through 6*c* of the accompanying drawings show exploded and cross-sectional views of a hosel region 610 in accordance with an alternative embodiment of the present invention. This alternative embodiment shown in FIGS. 6*a* through 6*c* is very similar to the embodiment previously discussed, except in this embodiment the shapes of the various components are tweaked slightly to ensure better interface between the various components. Similar to previous discussions, the hosel hole 618 in this embodiment shows one or more non-threaded recessed undercuts 620*a*, 620*b*, and 620*c*. These one or more non-threaded recessed undercuts 620*a*, 620*b*, and 620*c* are adapted to receive one or more non-threaded protrusions 621*a*, 621*b*, and 621*c* on the retention mechanism 616, via one or more attachment openings 622*a*, 622*b*, and 622*c* on the hosel cover 614. Finally, as previously discussed, the hosel cover has a male ledge 626 that is adapted to engage a female ledge 628 in the hosel hole 618 to retain the hosel hole cover 614 to the hosel hole 618.

Figure 7A:
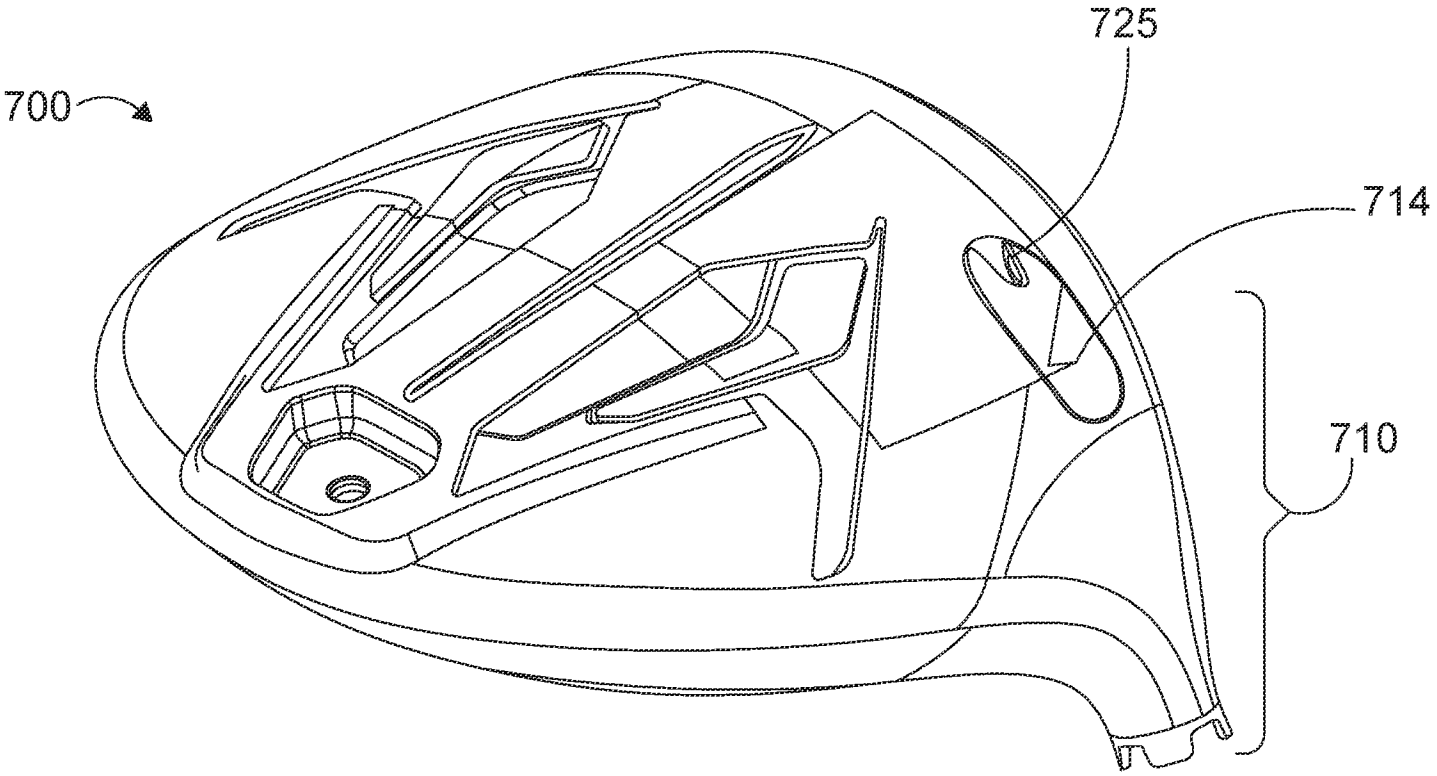
FIG. 7*a* of the accompanying drawings shows a bottom sole perspective view of a golf club head in accordance with another alternative embodiment of the present invention.

FIGS. 7*a* through 7*d* of the accompanying drawings shows a golf club head 700 in accordance with an alternative embodiment of the present invention. FIG. 7*a* shows this alternative embodiment of the present invention wherein the hosel region 710 of the golf club head 700 also has a hosel hole cover 714 located within a hosel hole 718. However, in this alternative embodiment of the present invention, the retention mechanism 716 is not visible once installed, leaving on the receptacle opening 725 visible. The cross-sectional area of this receptacle opening 725, in order to achieve the improved aerodynamics previously discussed, is also between about 55 $mm^2$ to about 300 $mm^2$, more specifically between about 65 $mm^2$ to about 200 $mm^2$, and most preferably about 90 $mm^2$.

Figure 7B:
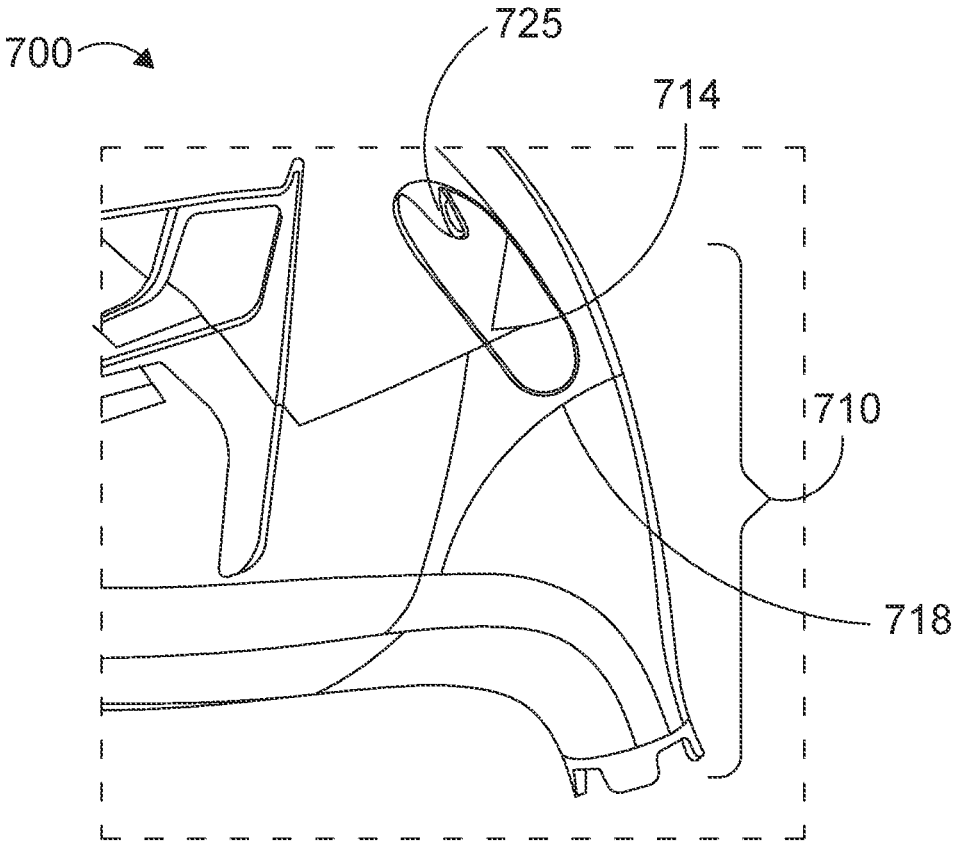
FIG. 7*b* of the accompanying drawings shows an enlarged view of a hosel region of a golf club head shown in FIG. 7*a* by enlarging the same circular region 2 shown in FIG. 1.
Figure 7C:
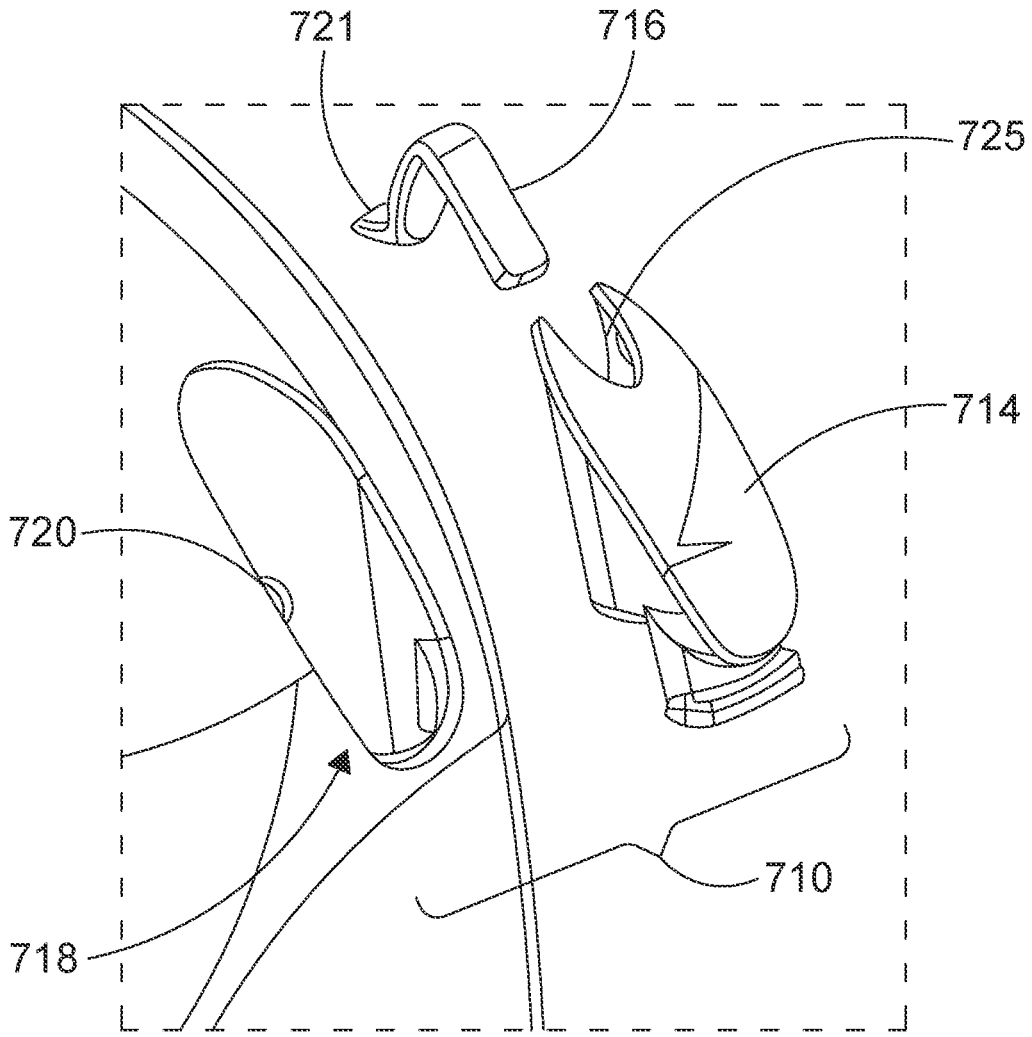
FIG. 7*c* of the accompanying drawings shows an exploded perspective view of a hosel region of a golf club head in accordance with another alternative embodiment of the present invention.
Figure 7D:
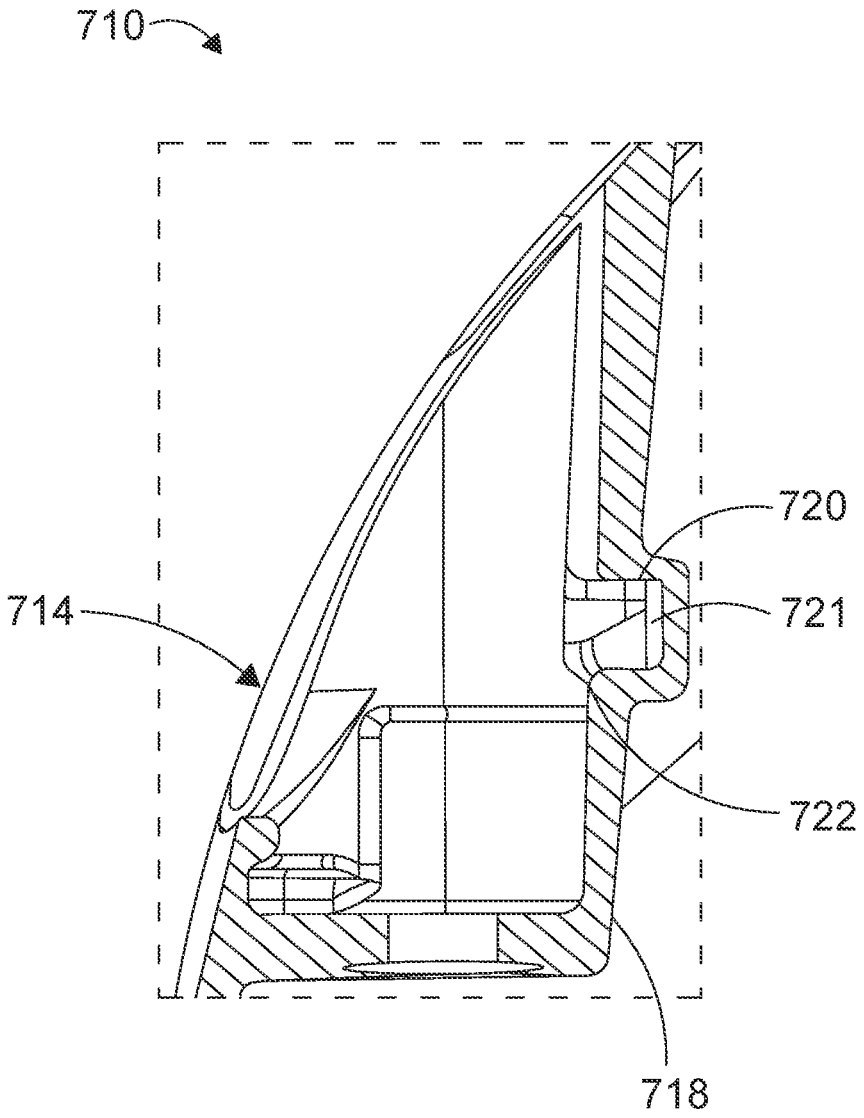
FIG. 7*d* of the accompanying drawings shows a partial cross-sectional view of a hosel region of a golf club head where the hosel hole cover is in a locked position in accordance with another alternative embodiment of the present invention.

FIG. 7*b* showing an exploded view of the golf club head 700 allows the previously invisible retention mechanism 716 to be shown more clearly. Based on this exploded view, we can see that the retention mechanism 716 is a tab based mechanism, wherein the non-threaded protrusion 721 engages a non-threaded recessed undercut 720 within the hosel hole 718 to secure the hosel hole cover 714 to the hosel hole 718. Based on this exploded view, we can see that the engagement mechanism 716 is not a rotational type of engagement mechanism like the previous embodiment. In fact, it is a deflection based retention mechanism 716 that deflects out of the way when subjected to an external force to snap into the non-threaded recessed undercut 720 to retain the hosel hole cover 714.

The external force to deflect the retention mechanism 716 can applied via any elongate member to be inserted into the hosel hole cover 714 through a receptacle opening 725. The insertion of the elongate member will cause the non-threaded protrusion to deflect away from the non-threaded recessed undercut 720, allowing the hosel hole cover 714 to be moved in and out of the hosel hole 718.

Figure 8A:
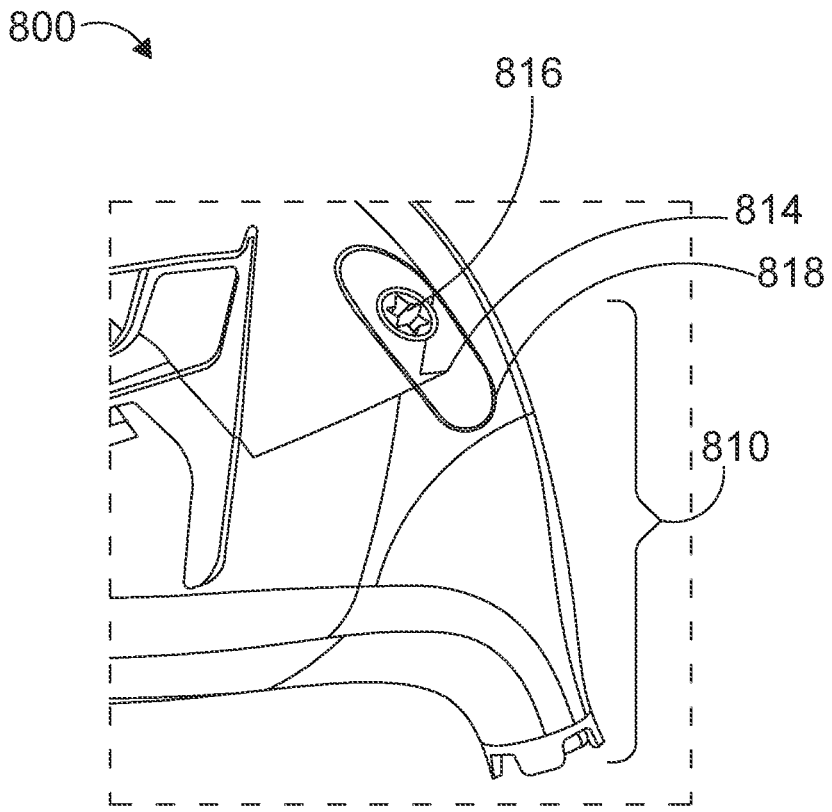
FIG. 8*a* of the accompanying drawings shows an enlarged view of a hosel region of a golf club head shown in accordance with an even further alternative embodiment of the present invention.
Figure 8B:
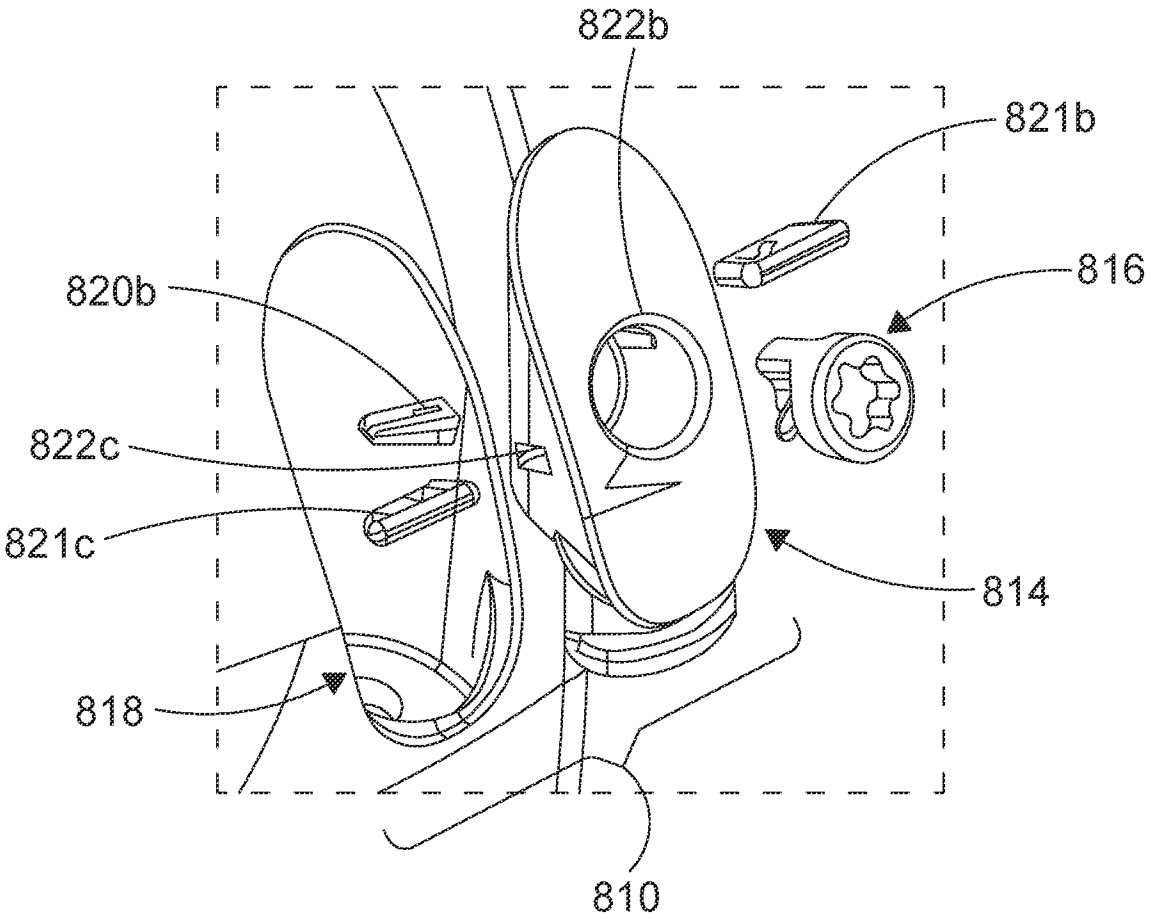
FIG. 8*b* of the accompanying drawings shows an exploded perspective view of a hosel region of a golf club head in accordance with an even further alternative embodiment of the present invention.

FIGS. 8*a* through 8*e* of the accompanying drawings illustrates a hosel portion 810 of a golf club head 800 in accordance with a further alternative embodiment of the present invention. In this alternative embodiment of the present invention shown in FIGS. 8*a* through 8*e*, a different type of engagement mechanism 816 is used to secure the hosel hole cover 814 to the hosel hole 818. The enlarged exploded view of the hosel portion 810 shown in FIG. 8*b* provides an easy to understand illustration of the various components used in this embodiment of the present invention. Although an initial glance as this alternative embodiment may appear complex, it actually operates very similar to the previous discussion relating to 180 degree rotation of the engagement mechanism 416 previously discussed and utilizes several similarly named components. However, in this embodiment of the present invention, the non-threaded protrusions 821*b* and 821*c* are not preinstalled on the retention mechanism 816, but rather are additional pieces that move with the rotation of the engagement mechanism 816. Additionally, the degree of rotation for this embodiment is only 90 degrees to turn from a locked position to an unlocked position. It should be noted that although the reduced amount of rotation of less than 360 degrees is critical to the proper functionality of the present invention to preserve simplicity, the actual number of degree of rotation can be either 90 degrees or 180 degrees all without departing from the scope and content of the present invention.

Figure 8C:
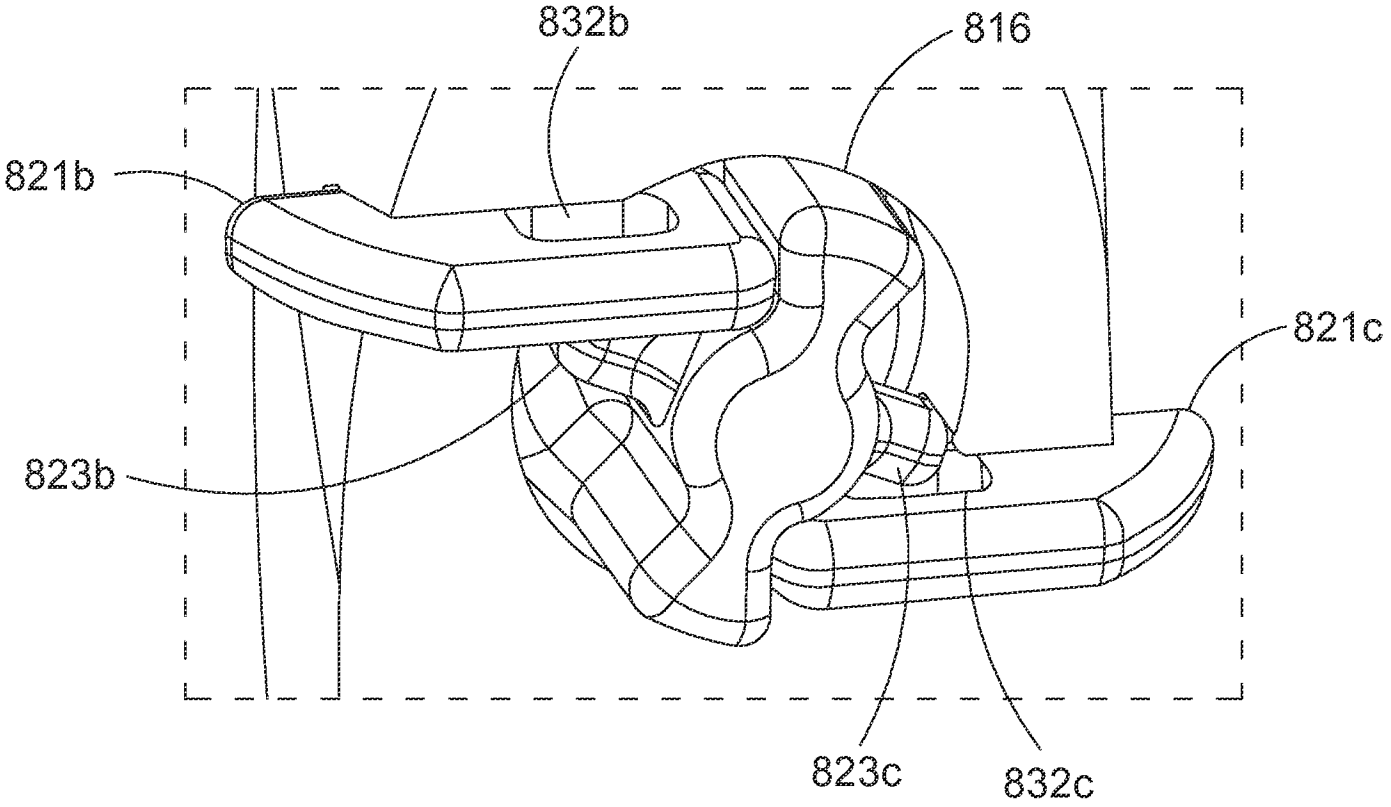
FIG. 8*c* of the accompanying drawings shows a rear view of a hosel region of a golf club head where the hosel hole cover is in an unlocked position in accordance with an even further alternative embodiment of the present invention.
Figure 8D:
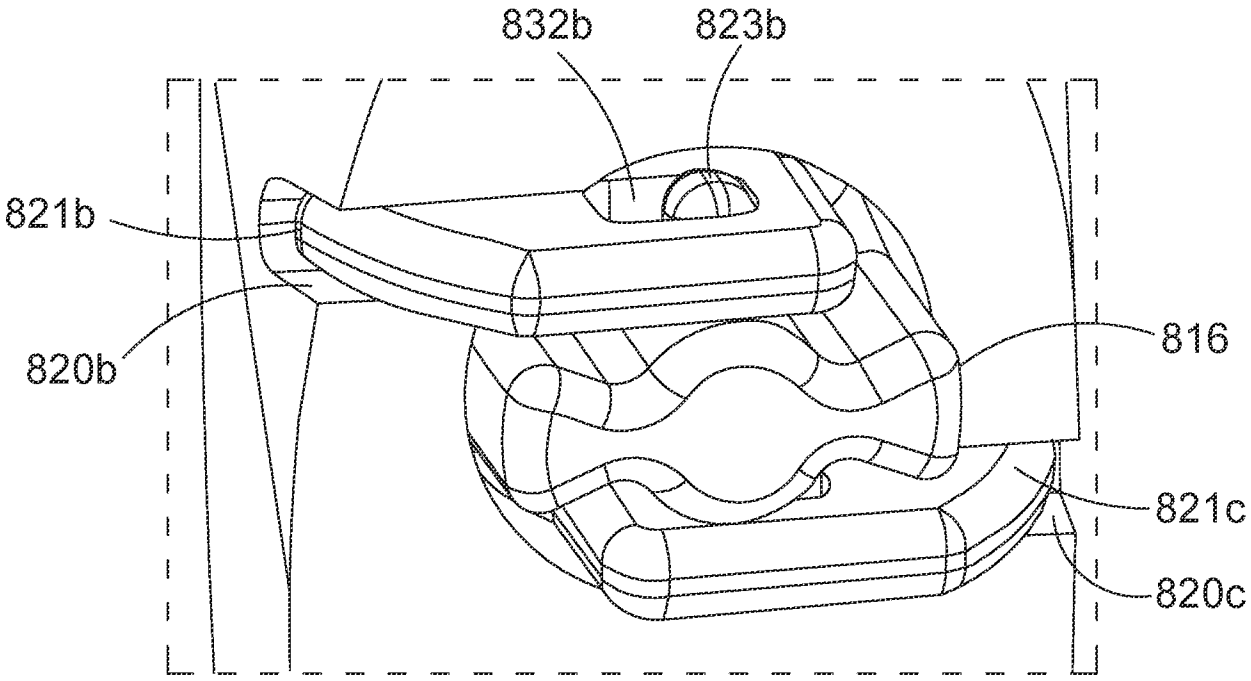
FIG. 8*d* of the accompanying drawings shows a rear view of a hosel region of a golf club head wherein the hosel hole cover is in a locked position in accordance with an even further alternative embodiment of the present invention.
Figure 8E:
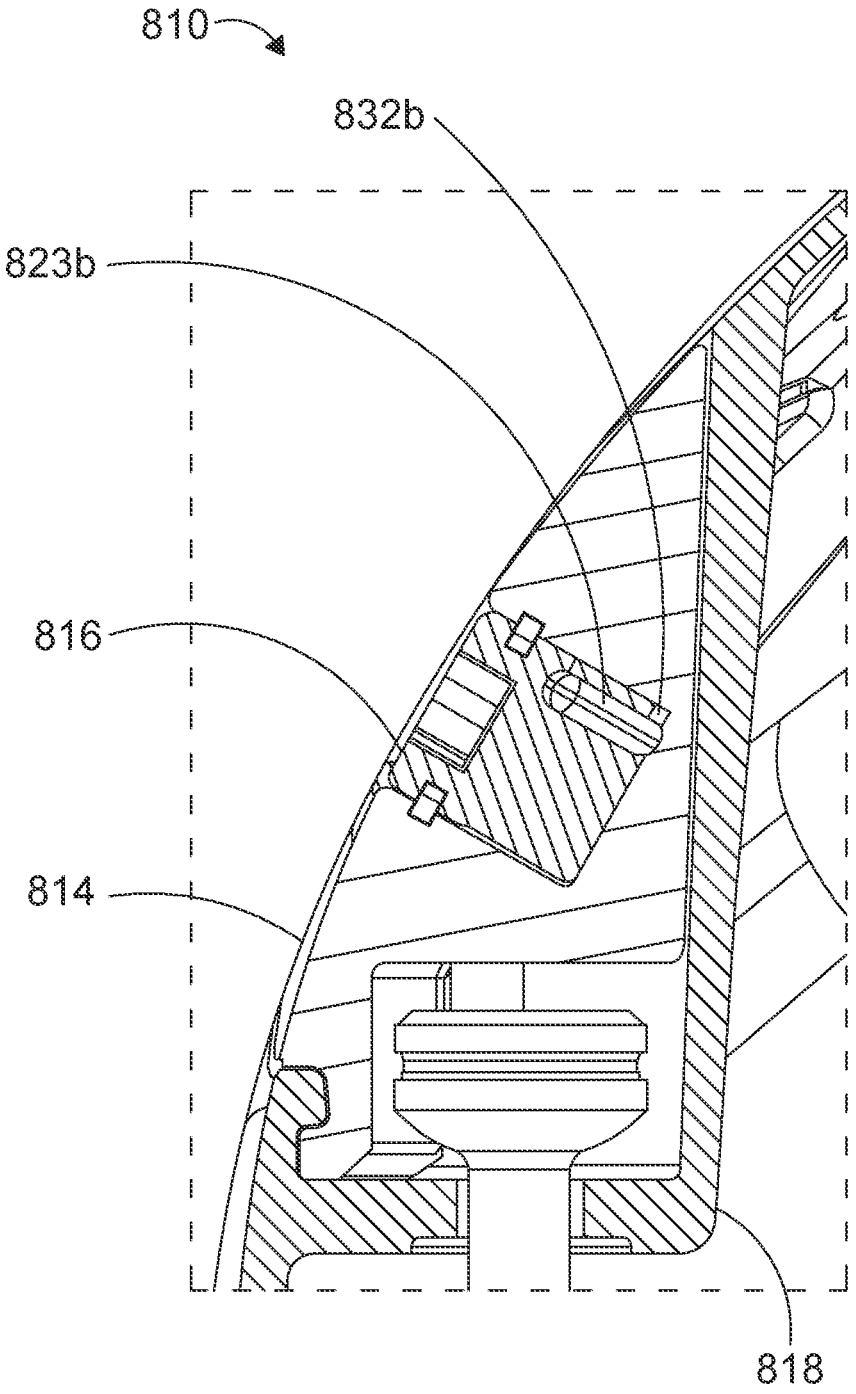
FIG. 8*e* of the accompanying drawings shows a partial cross-sectional view of a hosel region of a golf club head wherein the hosel cover is in a locked position in accordance with an even further alternative embodiment of the present invention.

Diving into more detail relating to this embodiment, it can be seen from FIG. 8*b* that the current embodiment, similar to previous embodiments, has two non-threaded recessed undercuts 820*b* and 820*c* (not shown) within the hosel hole 818 that are adapted to engage the non-threaded protrusions 821*b* and 821*c* via attachment openings 822*b* and 822*c* in the hosel hole cover 814. These non-threaded protrusions 821*b* and 821*c* are not attached to the retention mechanism 816 directly, but rather engage tabs 823*b* and 823*c* that translates rotational movement of the retention mechanism 816 into linear movements in the non-threaded protrusions 821*b* and 821*c*. FIGS. 8*c* through 8*d* provides a rear internal view of the retention mechanism 816 in both the unlocked and locked position respectively, further illustrating the concept explained above. In FIG. 8*c*, when the retention mechanism is in an unlocked position, we can see that the tabs 823*b* and 823*c* that protrude out from the retention mechanism 816 does not engage the non-threaded recessed undercuts 820*b* and 820*c* directly when the retention mechanism 816 is rotated. Rather, tabs 823*b* and 823*c* are adapted to engage slots 832*b* and 832*c* in the non-threaded protrusions 821*b* and 821*c*; and when the engagement mechanism 816 is rotated to a locked position as shown in FIG. 8*d*, the rotational movement of the retention mechanism 816 engages the tabs 823*b* and 823*c* with the slots 832*b* and 832*c* to retain the hosel hole cover 814 to the hosel hole 818, which can also be seen in the cross-sectional view of the hosel portion 810.

Figure 9A:
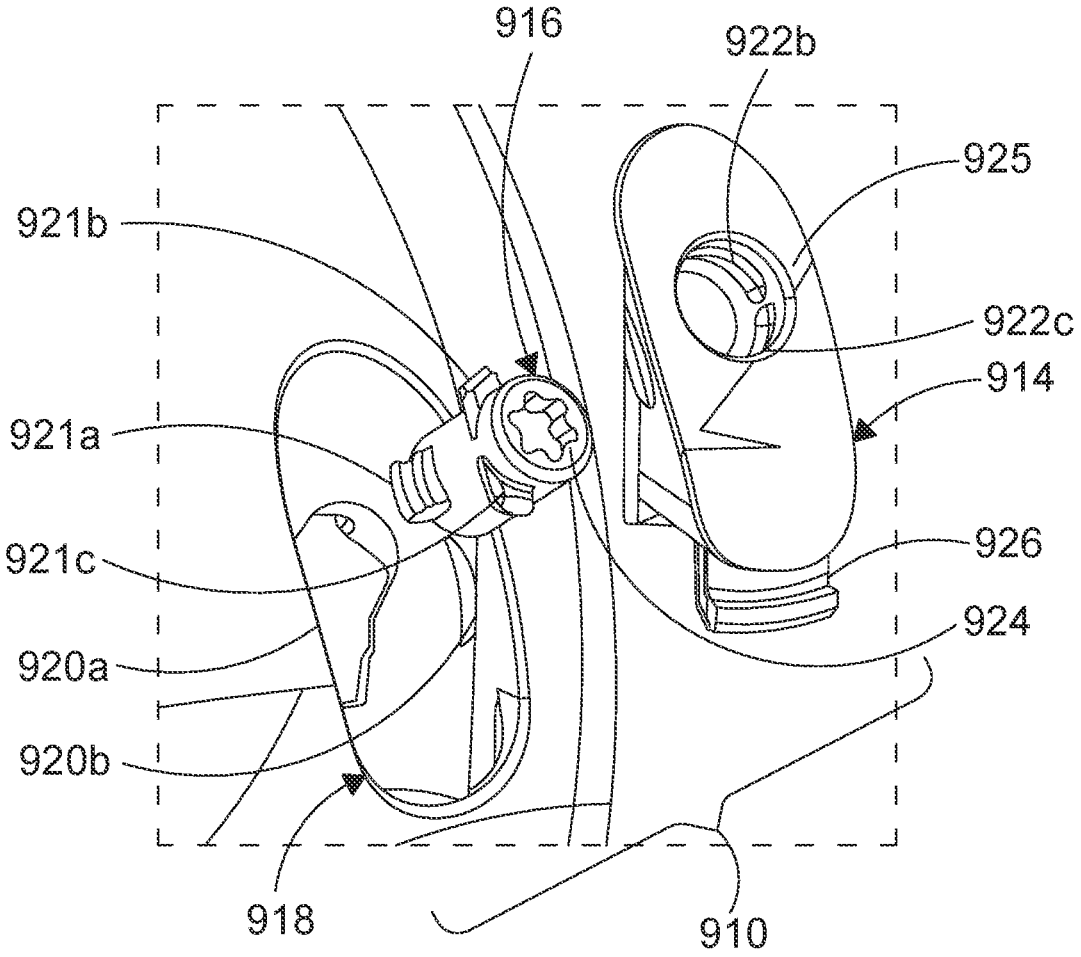
FIG. 9*a* of the accompanying drawings shows an exploded perspective view of a hosel region of a golf club head in accordance with another alternative embodiment of the present invention.
Figure 9B:
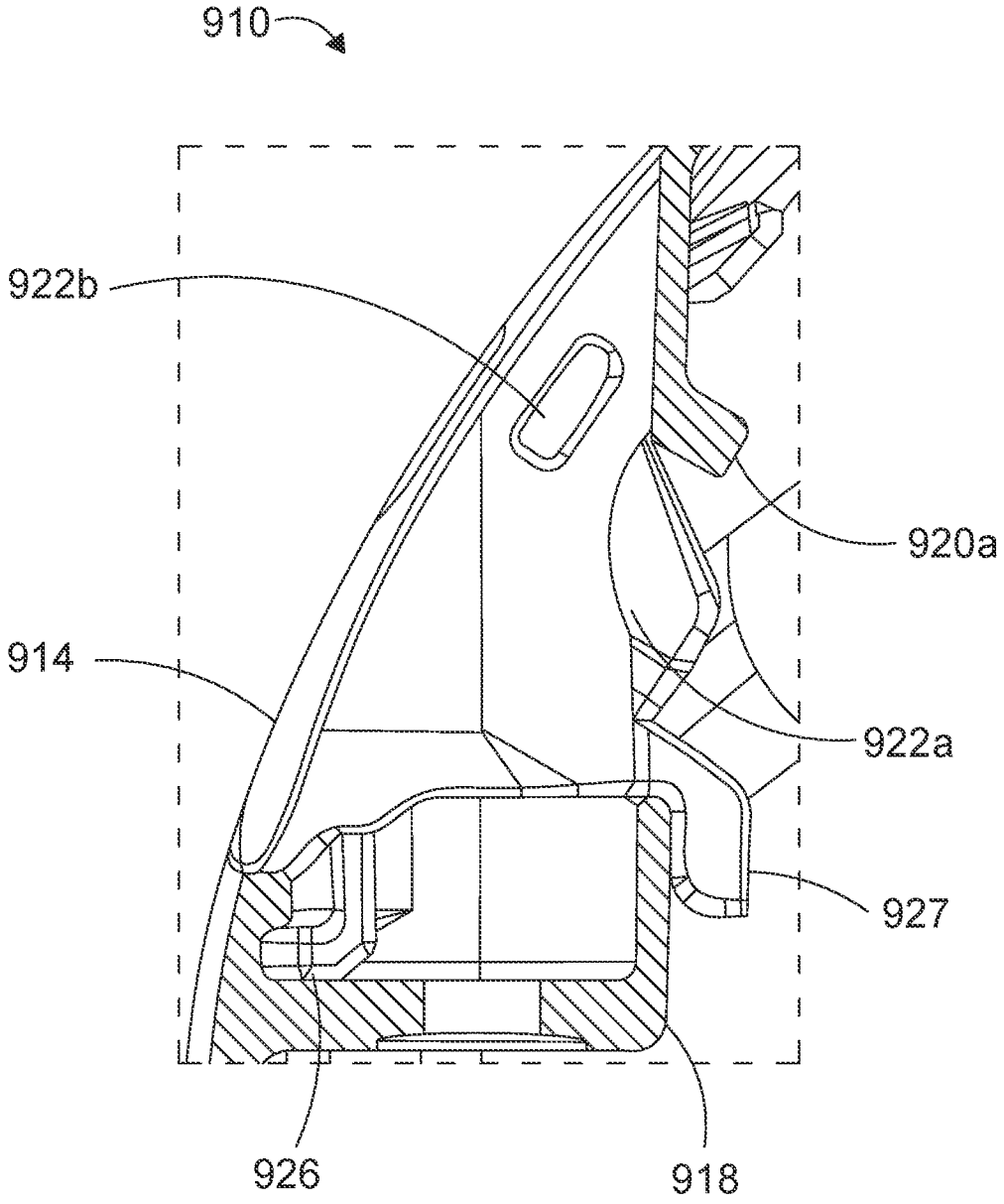
FIG. 9*b* of the accompanying drawings shows a partial cross-sectional view of a hosel region of a golf club head wherein the hosel cover is in an unlocked position in accordance with another alternative embodiment of the present invention.
Figure 9C:
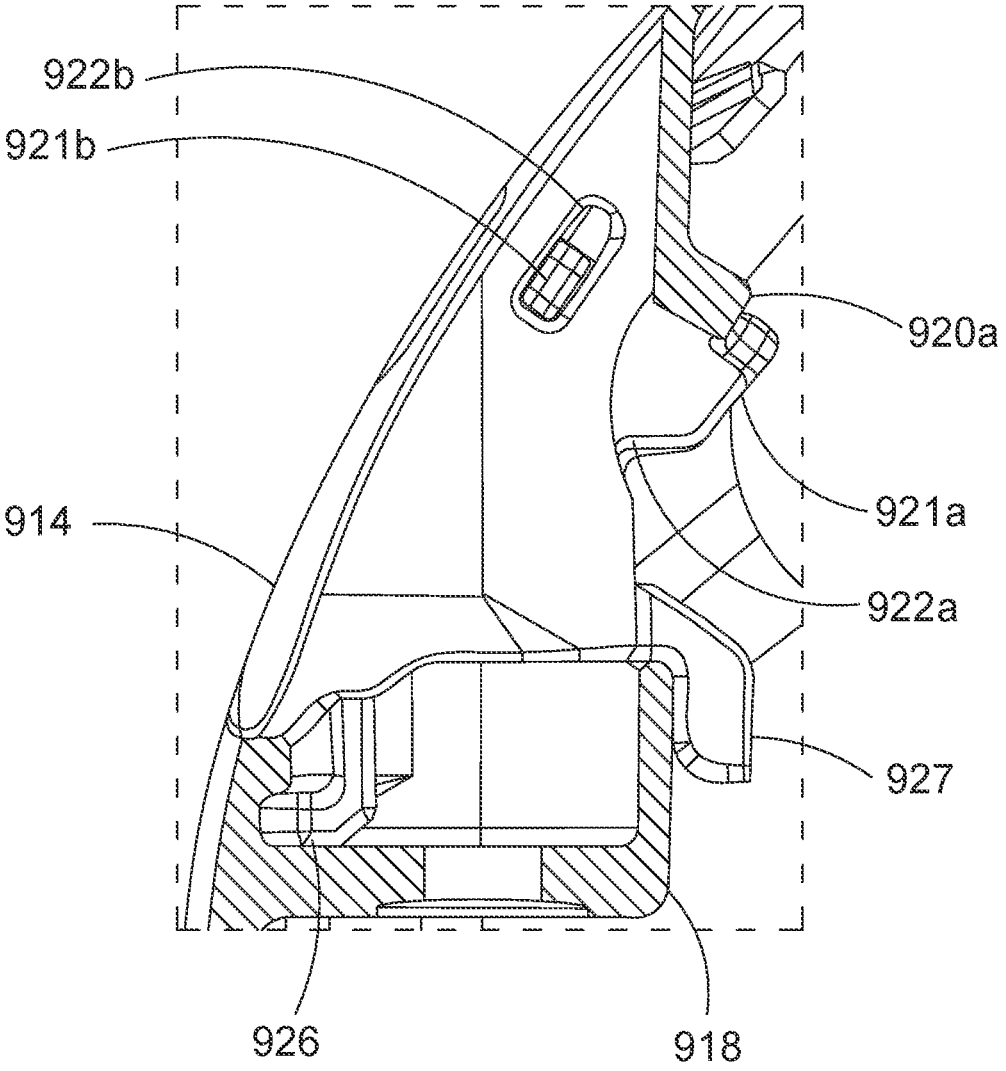
FIG. 9*c* of the accompanying drawings shows a partial cross-sectional view of a hosel region of a golf club head wherein the hosel cover is in a locked position in accordance with another alternative embodiment of the present invention.

FIGS. 9*a* through 9*c* of the accompanying drawings shows a hosel portion 910 of a golf club head 900 in accordance with a further alternative embodiment of the present invention. This embodiment of the present invention, similar to previous embodiments, incorporates rotational movement of the retention mechanism 916 to move one or more non-threaded protrusions 921*a*, 921*b*, and 921*c* to engage one or more non-threaded recessed undercuts 920*a*, 920*b*, and 920*c* in the hosel hole 918, via one or more attachment openings 922*a*, 922*b*, and 922*c* in the hosel hole cover 914. The receptacle opening 925 in the hosel hole cover 914 works in the same way as previous described, and is adapted to receive the retention mechanism 916 by guiding it into a starting/unlocked orientation, and rotating the retention mechanism 916 180 degrees will secure the hosel hole cover 914 to the hosel hole 918. The major difference in this embodiment compared to previous embodiments of the present invention is that the hosel hole cover 914 further comprises of a internal ledge 927 in addition to the male ledge 926 to help secure the hosel hole cover 914 to the hosel hole 918. Additionally, this embodiment of the present invention creates the first non-threaded recessed undercut 920*a* that is of a different shape and protrudes out more than the previous embodiments.

Figure 10A:
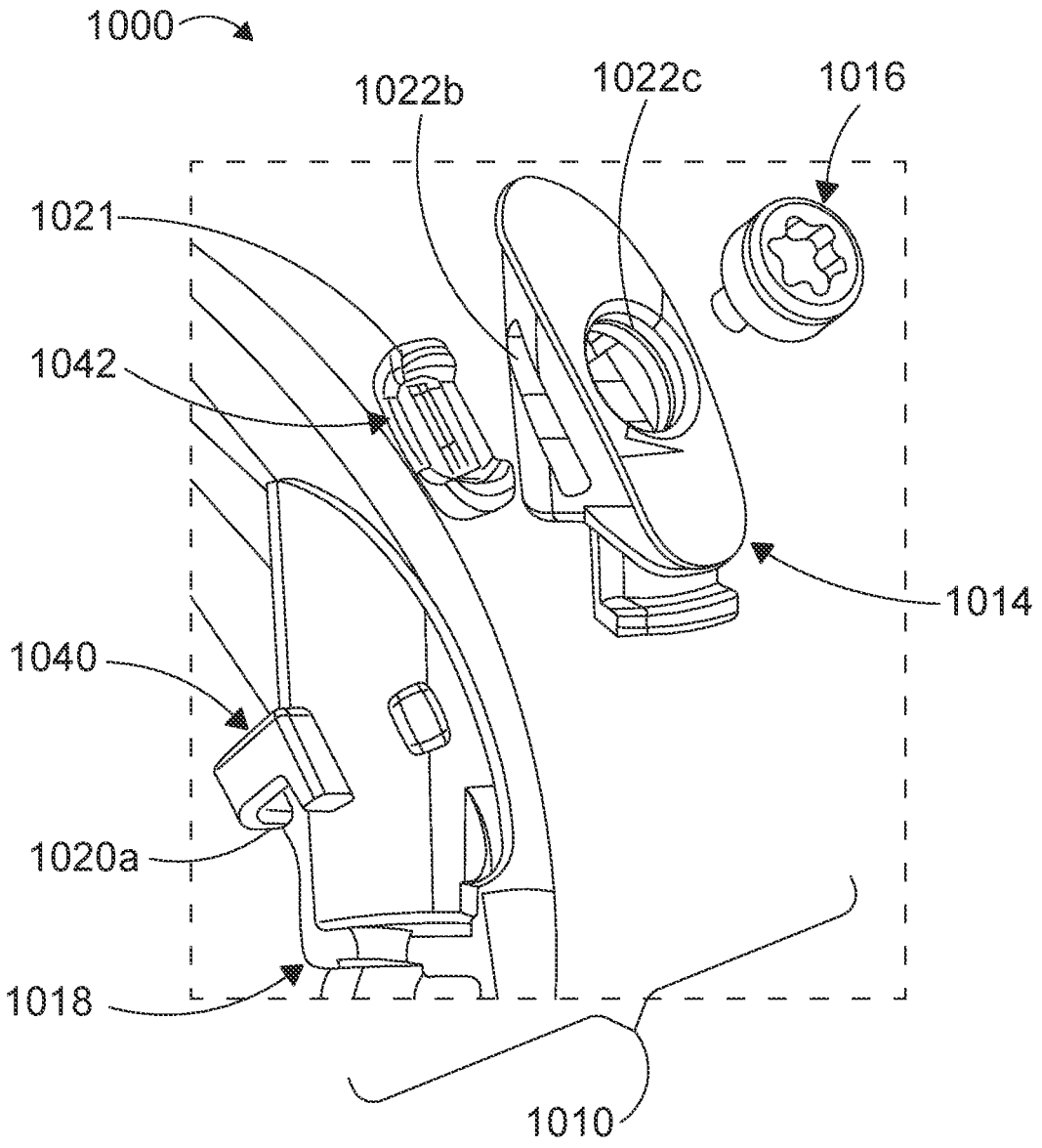
FIG. 10*a* of the accompanying drawings shows an exploded perspective view of a hosel region of a golf club head in accordance with another alternative embodiment of the present invention.
Figure 10B:
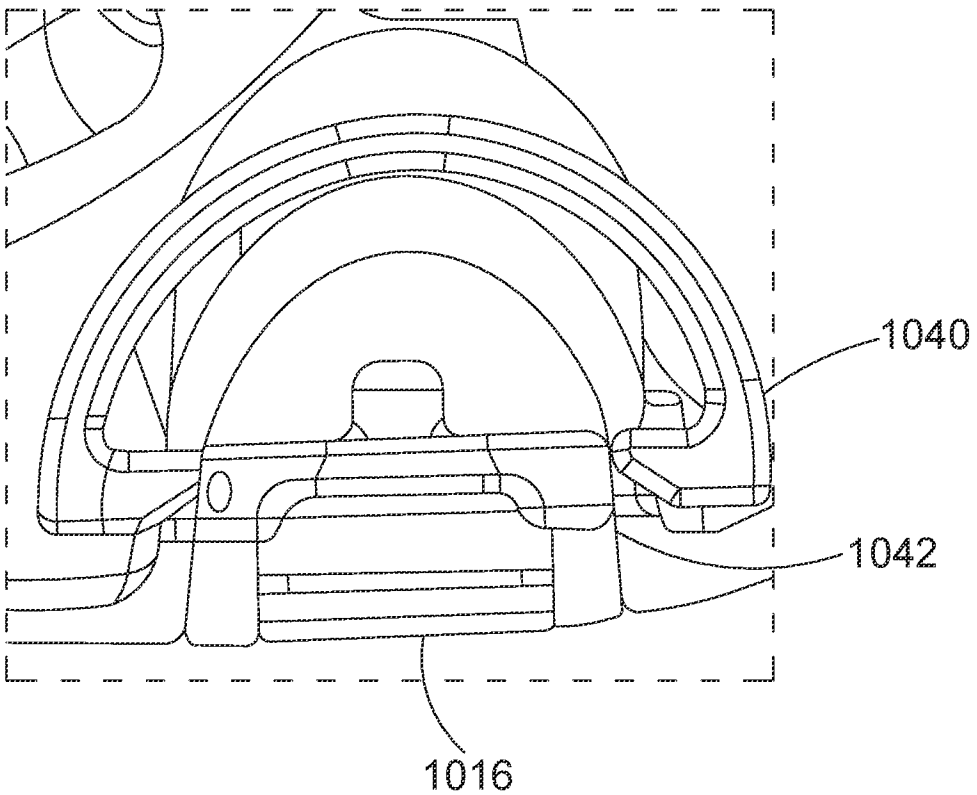
FIG. 10*b* of the accompanying drawings shows a rear internal view of a hosel region of a golf club head wherein the hosel cover is in an unlocked position in accordance with another alternative embodiment of the present invention.
Figure 10C:
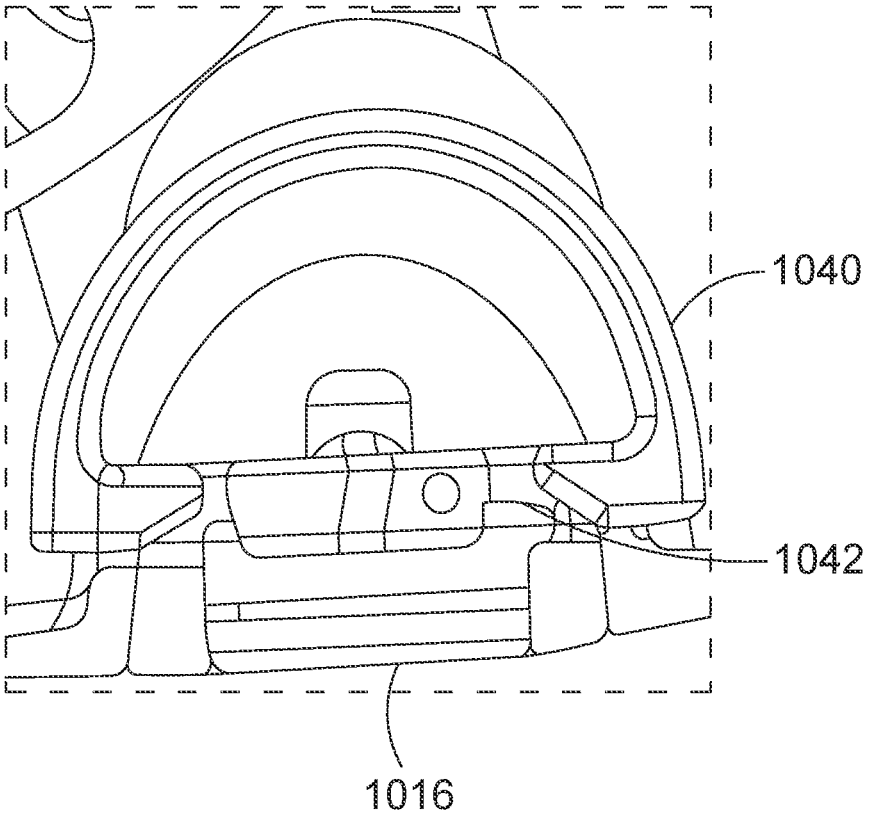
FIG. 10*c* of the accompanying drawings shows a rear internal view of a hosel region of a golf club head wherein the hosel cover is in a locked position in accordance with another alternative embodiment of the present invention.

FIG. 10*a* through 10*c* of the accompanying drawings shows hosel portion 1010 of a golf club head 1000 in accordance with a further alternative embodiment of the present invention. In this alternative embodiment, the non-threaded recessed undercut 1020*a* is formed via a spring clip 1040 within the hosel hole 1018 and the non-threaded protrusion 1021 is formed via a rotatable member 1042 that engages the retention mechanism 1016. The hosel hole cover 1014 shown here is essentially the same as previous embodiments, and the attachment opening 1022*b* shown here is oversized, in order to accommodate the need for the rotatable member 1042 to move and engage the spring clip 1040. Using an oversized rotatable member 1042 to engage a spring clip 1040 may be preferred in this embodiment of the present invention in order to provide a more robust solid retention mechanism, although at the expense of adding some additional components. FIG. 10*b* of the accompanying drawings shows the relationship between the spring clip 1040 and the rotatable member 1042 together with the retention mechanism 1016 in an unlocked position, where FIG. 10*c* of the accompanying drawings shows the same components in a locked position. In an alternative embodiment of the present invention, a spring member (not shown)

may be added to return the rotatable member 1042 to a natural locked position to enhance the usability of the present invention.

Figure 11A:
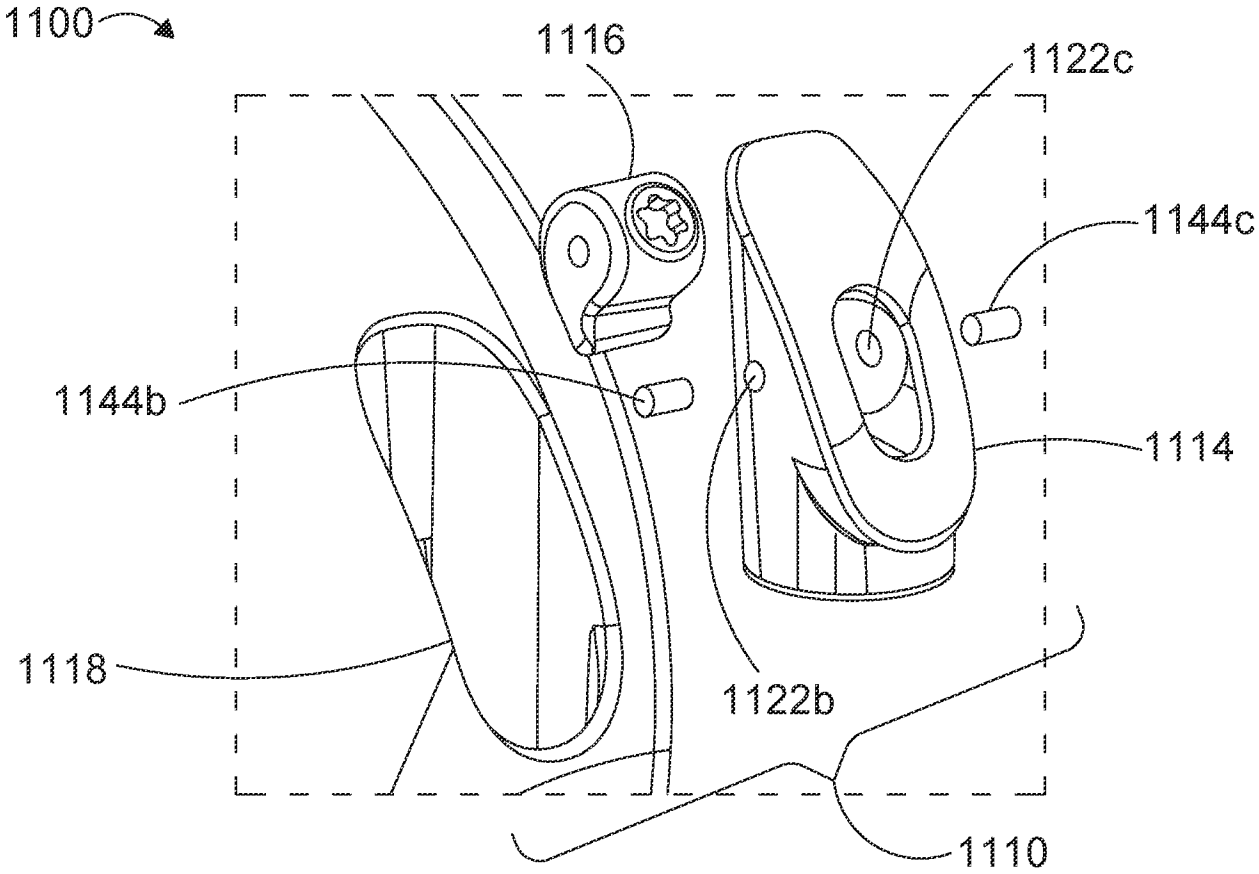
FIG. 11*a* of the accompanying drawings shows an exploded perspective view of a hosel region of a golf club head in accordance with another alternative embodiment of the present invention.
Figure 11B:
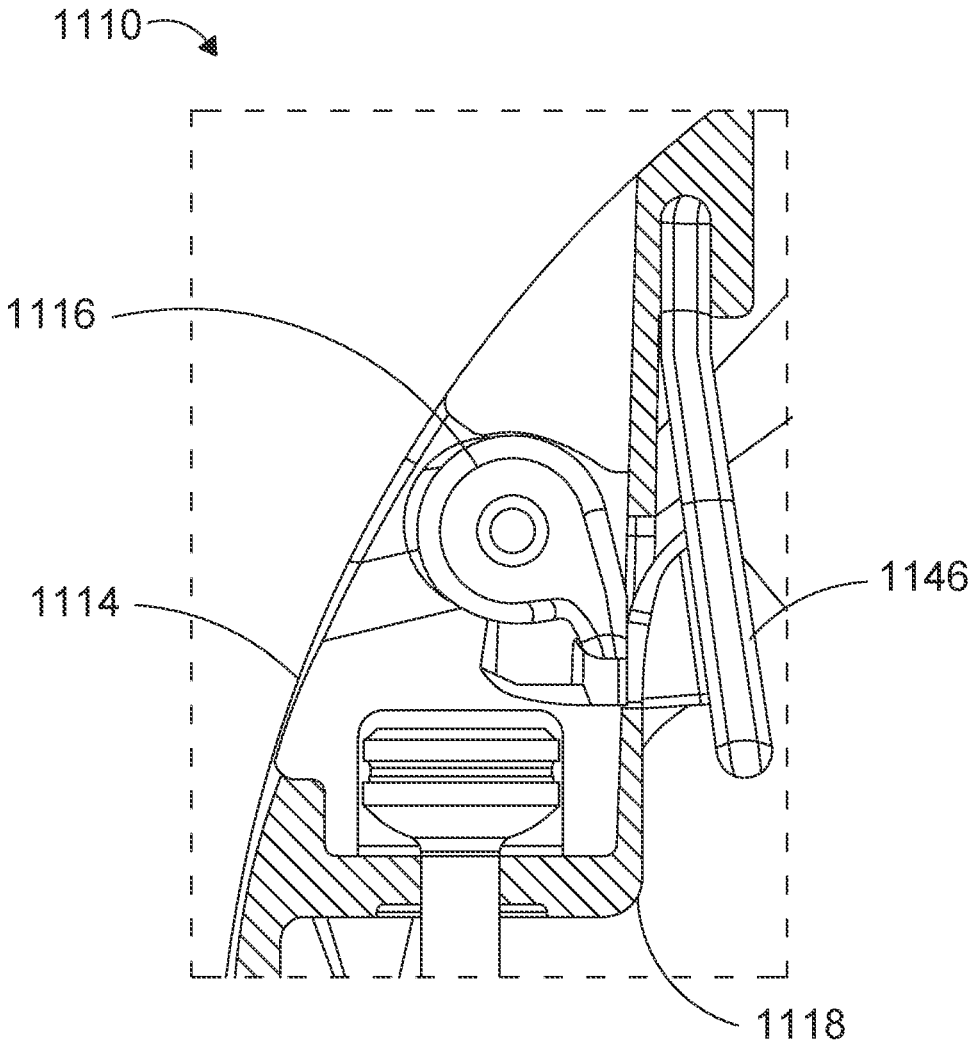
FIG. 11*b* of the accompanying drawings shows a partial cross-sectional view of a hosel region of a golf club head wherein the hosel cover is in an unlocked position in accordance with another alternative embodiment of the present invention.
Figure 11C:
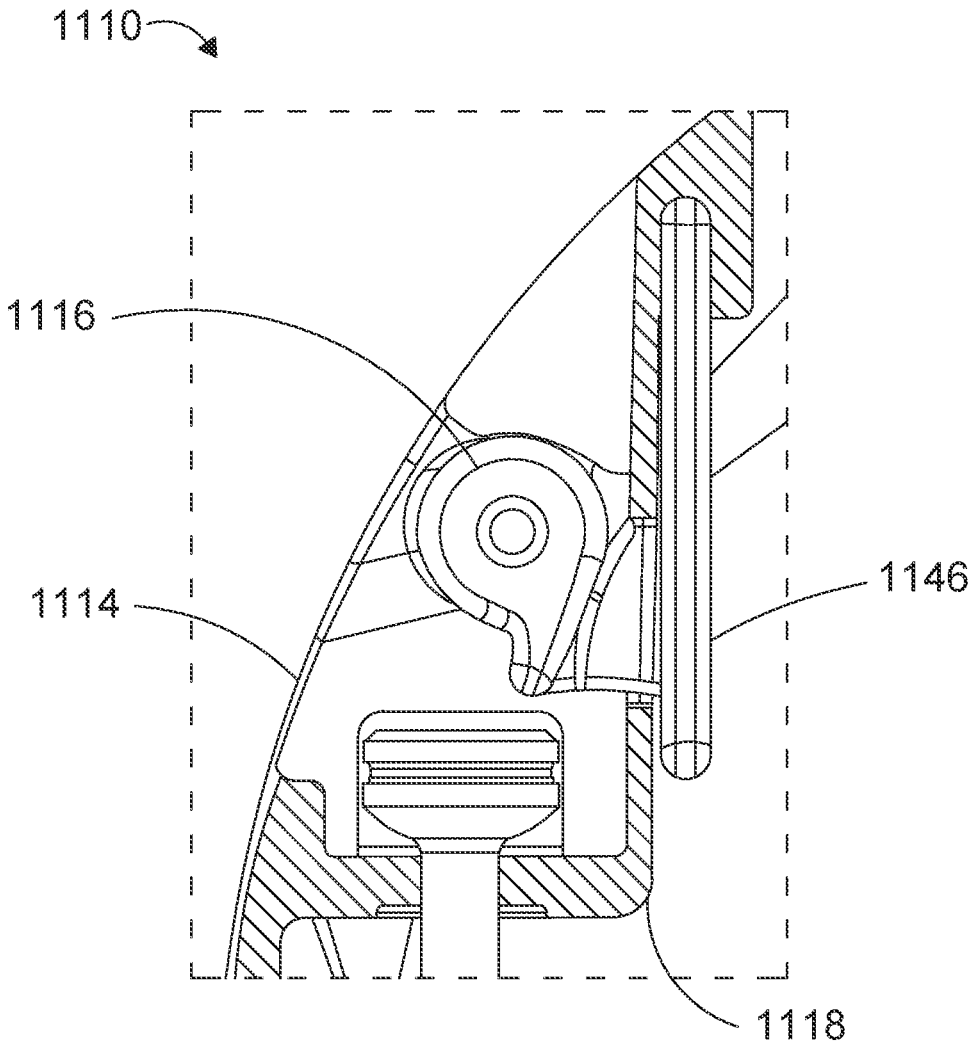
FIG. 11*c* of the accompanying drawings shows a partial cross-sectional view of a hosel region of a golf club head wherein the hosel cover is in a locked position in accordance with another alternative embodiment of the present invention.

FIGS. 11*a* through 11*c* of the accompanying drawings illustrate the hosel portion 1110 of a golf club head 1100 in accordance with an even further alternative embodiment of the present invention. In this alternative embodiment of the present invention, the retention mechanism 1116 helps retain the hosel hole cover 1114 within the hosel hole 1118 by rotating along a plurality of pins 1114*b* and 1114*c* that protrude out from attachment openings 1122*b* and 1122*c* within the hosel hole cover 1114. In an alternative embodiment of the present invention, the plurality of pins 1114*b* and 1114*c* could be one long pin without departing from the scope and content of the present invention. The rotation of the retention mechanism 1116 engages a flap 1146 within the hosel hole 1118 to help retain the hosel hole cover 1114 within the hosel hole 1118. FIG. 11*b* shows the hosel portion 1110 in an unlocked position, while FIG. 11*c* shows the hosel portion in a locked position.

Figure 12A:
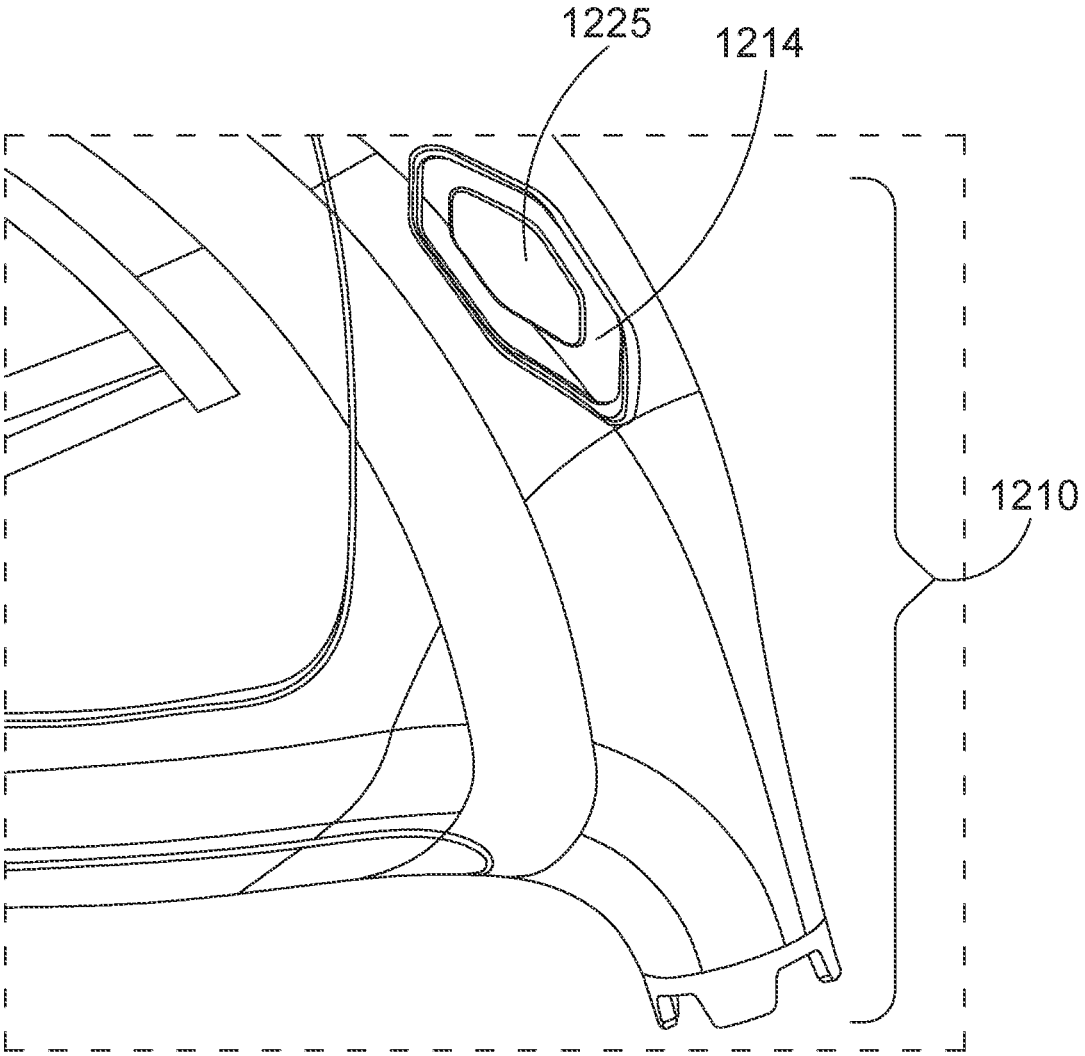
FIG. 12*a* of the accompanying drawings shows an enlarged view of a hosel region of a golf club head in accordance with an even further alternative embodiment of the present invention.
Figure 12B:
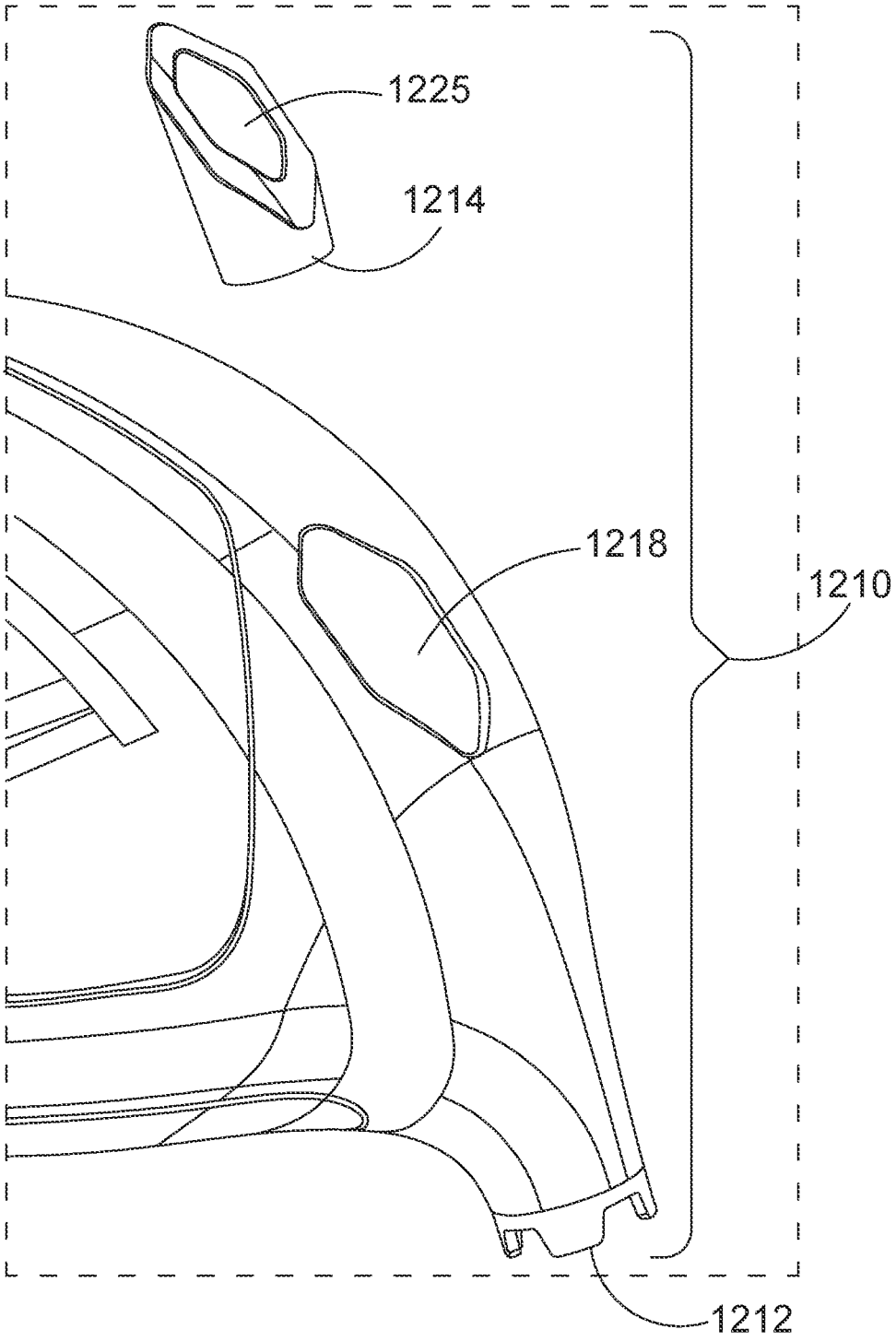
FIG. 12*b* of the accompanying drawings shows an exploded perspective view of a hosel region of a golf club head in accordance with an even further alternative embodiment of the present invention.
Figure 12C:
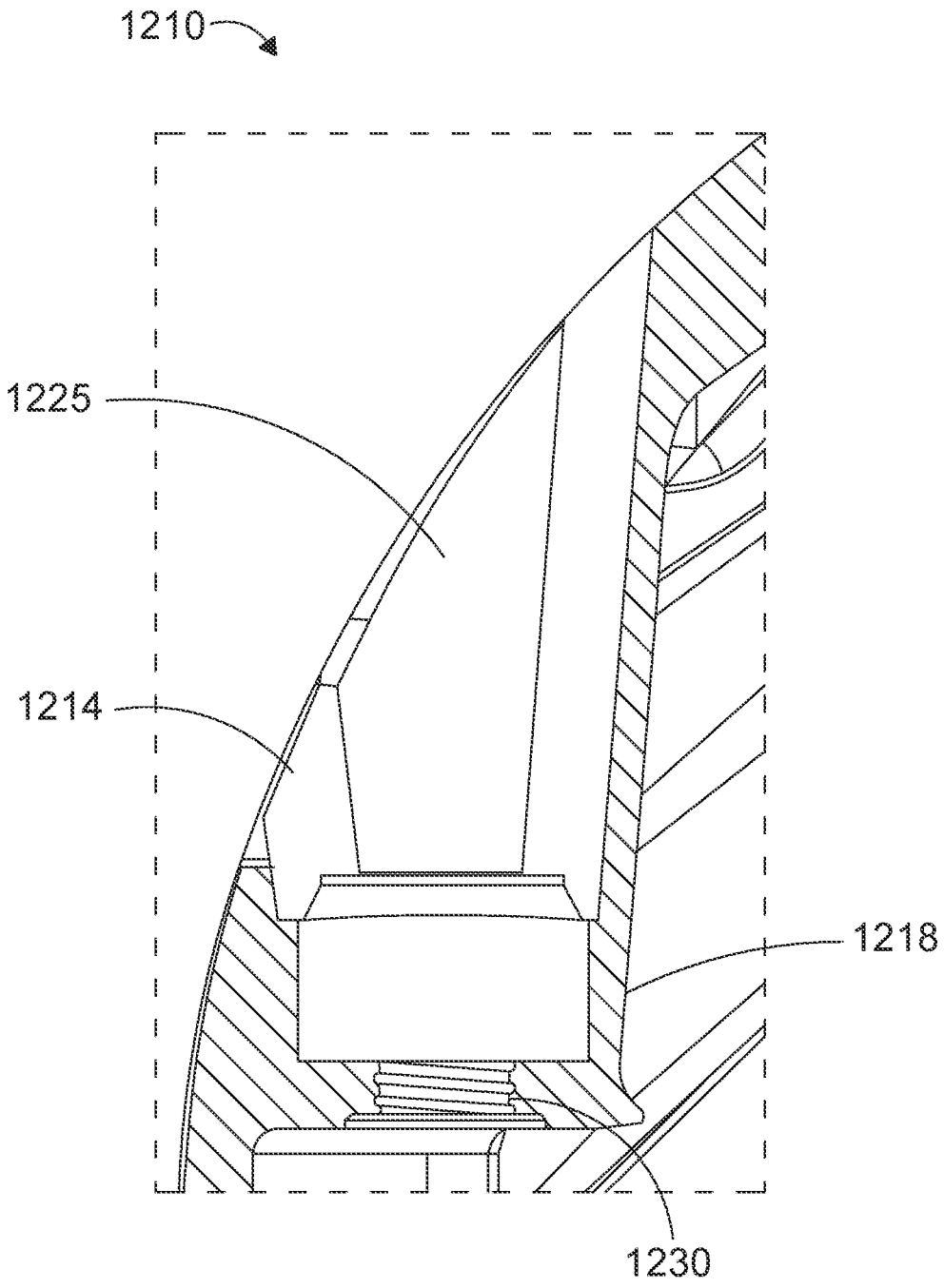
FIG. 12*c* of the accompanying drawings shows a partial cross-sectional view of a hosel region of a golf club head in accordance with an even further alternative embodiment of the present invention.

FIGS. 12*a* through 12*c* of the accompanying drawings shows a hosel portion 1210 of a golf club head in accordance with an even further alternative embodiment of the present invention. In this further alternative embodiment of the present invention, the hosel hole cover 1214 is attached to go on top of the hosel hole 1218 without the need of a retention mechanism. In fact, the hosel hole cover 1214 in this embodiment is merely retained in the hosel hole 1218 via glue, instead of an advanced retention mechanism as illustrated in previous embodiments. Since the glued in hosel hole cover 1214 is not going to be releasable, the receptacle opening 1225 need to be large enough to accommodate the threaded screw 1230 to attach to a shaft via the releasable shaft mechanism 1212. Hence, it is worth reiterating here that in order to preserve the aerodynamic benefit of the hosel hole cover 1214, the receptacle opening 1225 may have a surface area of between about 55 $mm^2$ to about 300 $mm^2$, more specifically between about 65 $mm^2$ to about 200 $mm^2$, and most preferably about 90 $mm^2$.

Figure 13A:
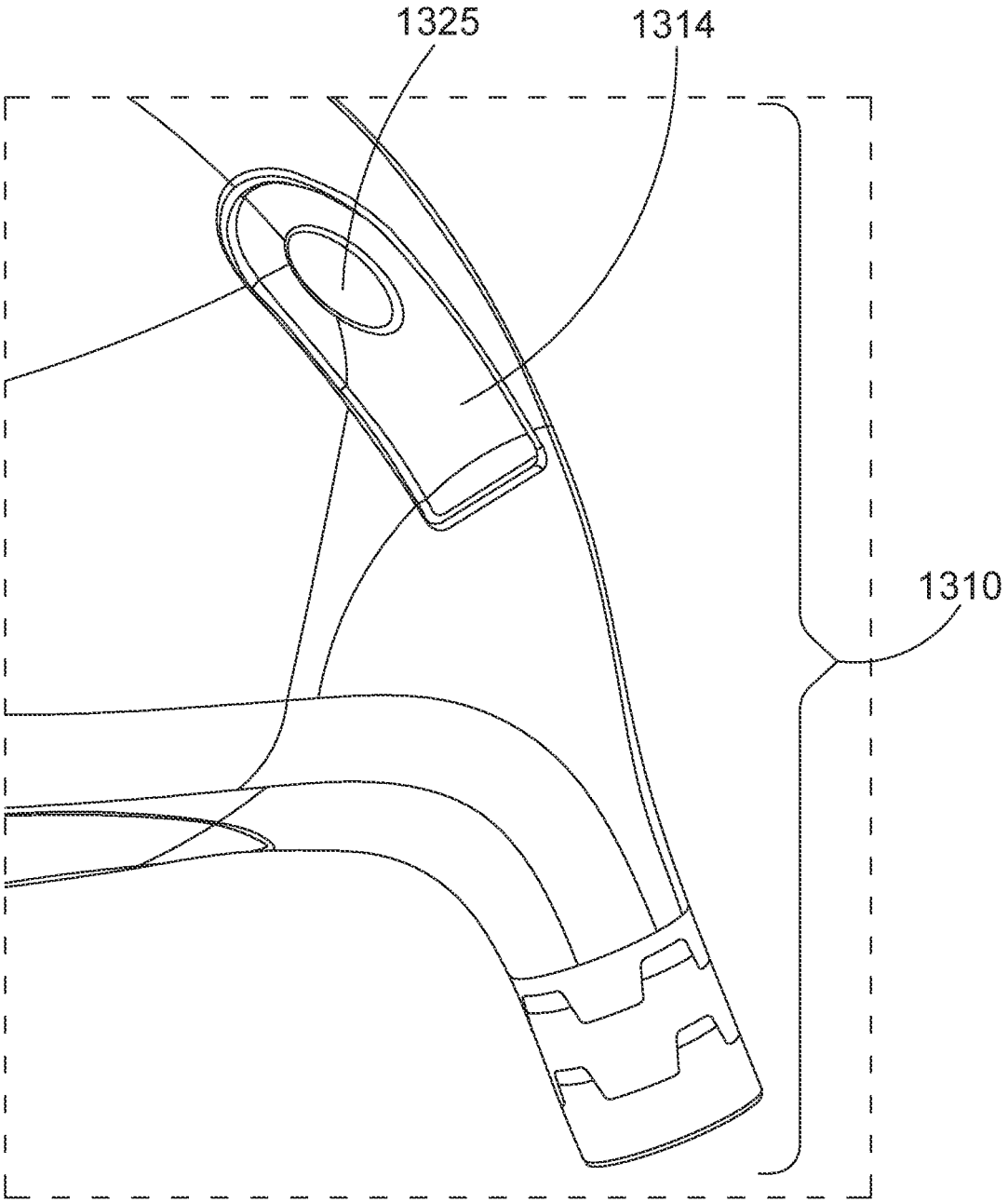
FIG. 13*a* of the accompanying drawings shows an enlarged view of a hosel region of a golf club head in accordance with an even further alternative embodiment of the present invention.
Figure 13B:
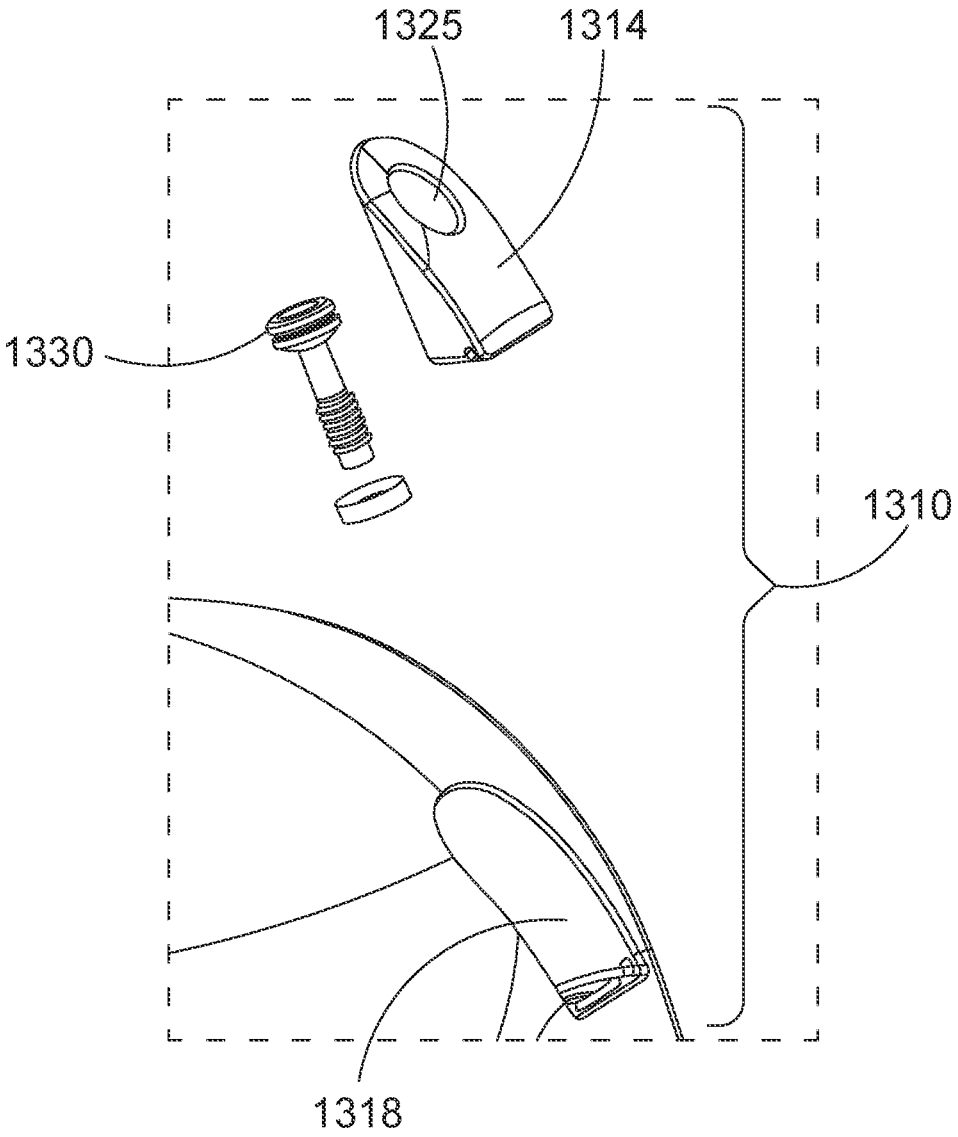
FIG. 13*b* of the accompanying drawings shows an exploded perspective view of a hosel region of a golf club head in accordance with an even further alternative embodiment of the present invention.
Figure 13C:
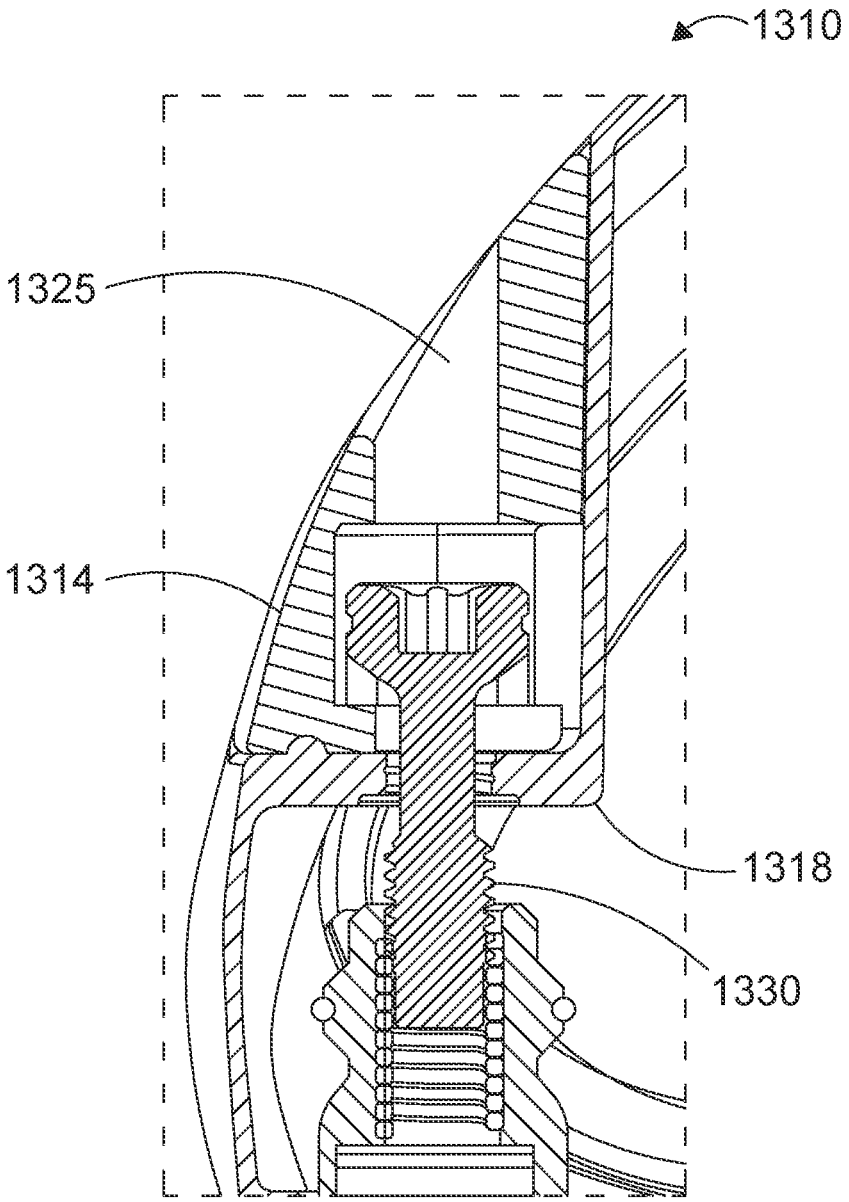
FIG. 13*c* of the accompanying drawings shows a partial cross-sectional view of a hosel region of a golf club head in accordance with an even further alternative embodiment of the present invention.

FIG. 13*a* through 13*c* of the accompanying drawings shows a hosel portion 1310 of a golf club head in accordance with an even further alternative embodiment of the present invention. In this further alternative embodiment of the present invention, the hosel hole cover 1314, once again, does not incorporate an additional component of a retention mechanism, but rather utilizes the existing threaded screw 1330 that is used to attach to a shaft to also secure the hosel hole cover 1314 to the hosel hole 1318. The receptacle opening 1325, similar to all previous embodiments, needs to have the right surface area and the right size to promote the aerodynamic benefits previously discussed.

Figure 14A:
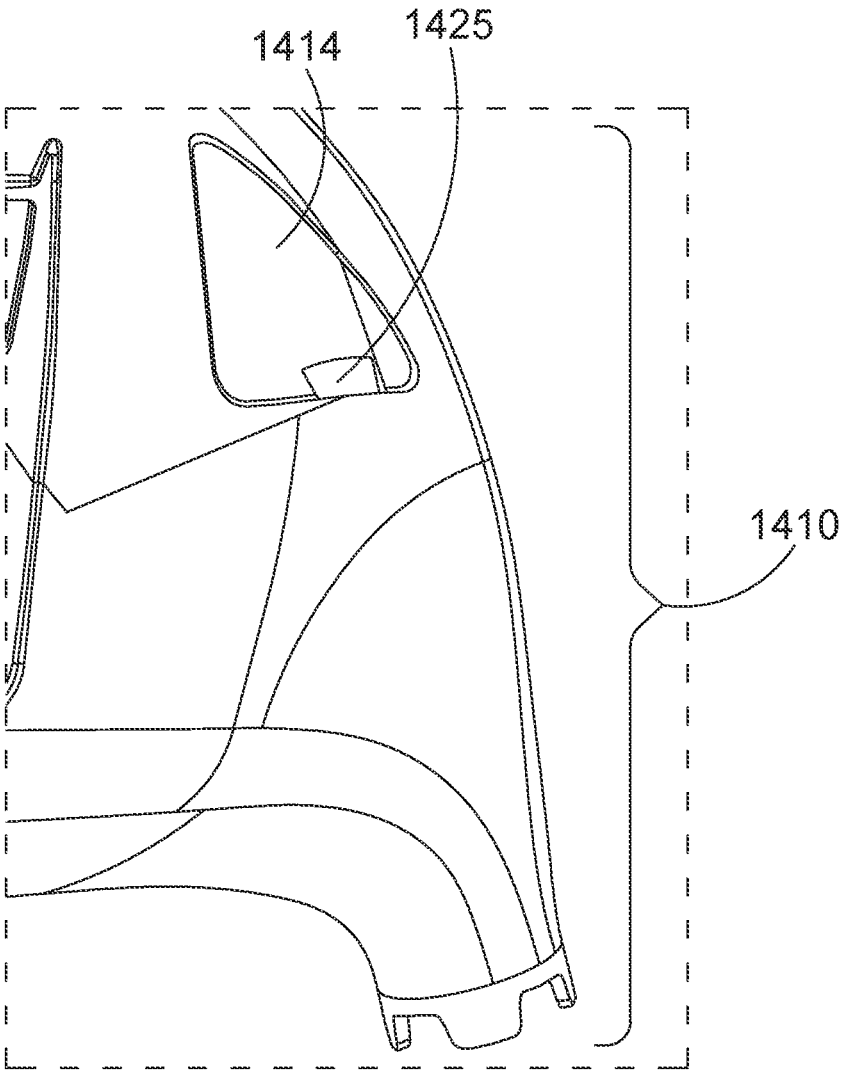
FIG. 14*a* of the accompanying drawings shows an enlarged view of a hosel region of a golf club head in accordance with an even further alternative embodiment of the present invention.
Figure 14B:
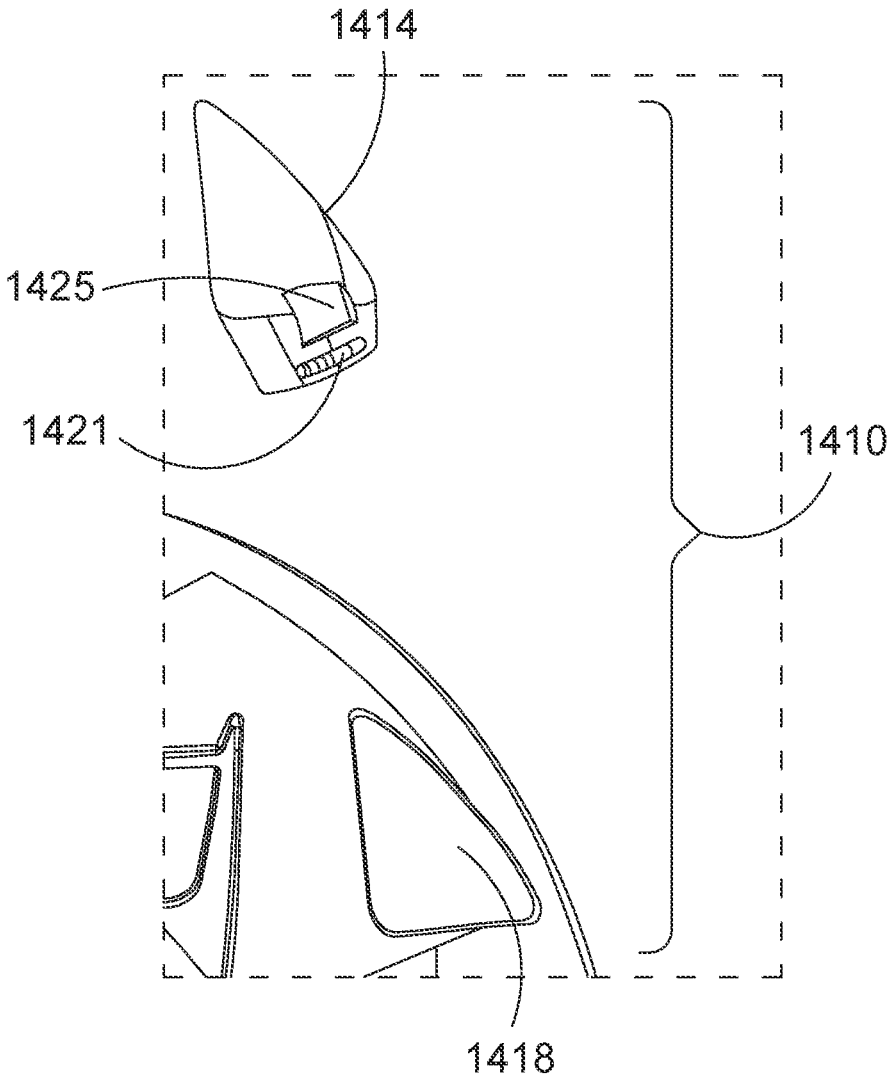
FIG. 14*b* of the accompanying drawings shows an exploded perspective view of a hosel region of a golf club head in accordance with an even further alternative embodiment of the present invention.
Figure 14C:
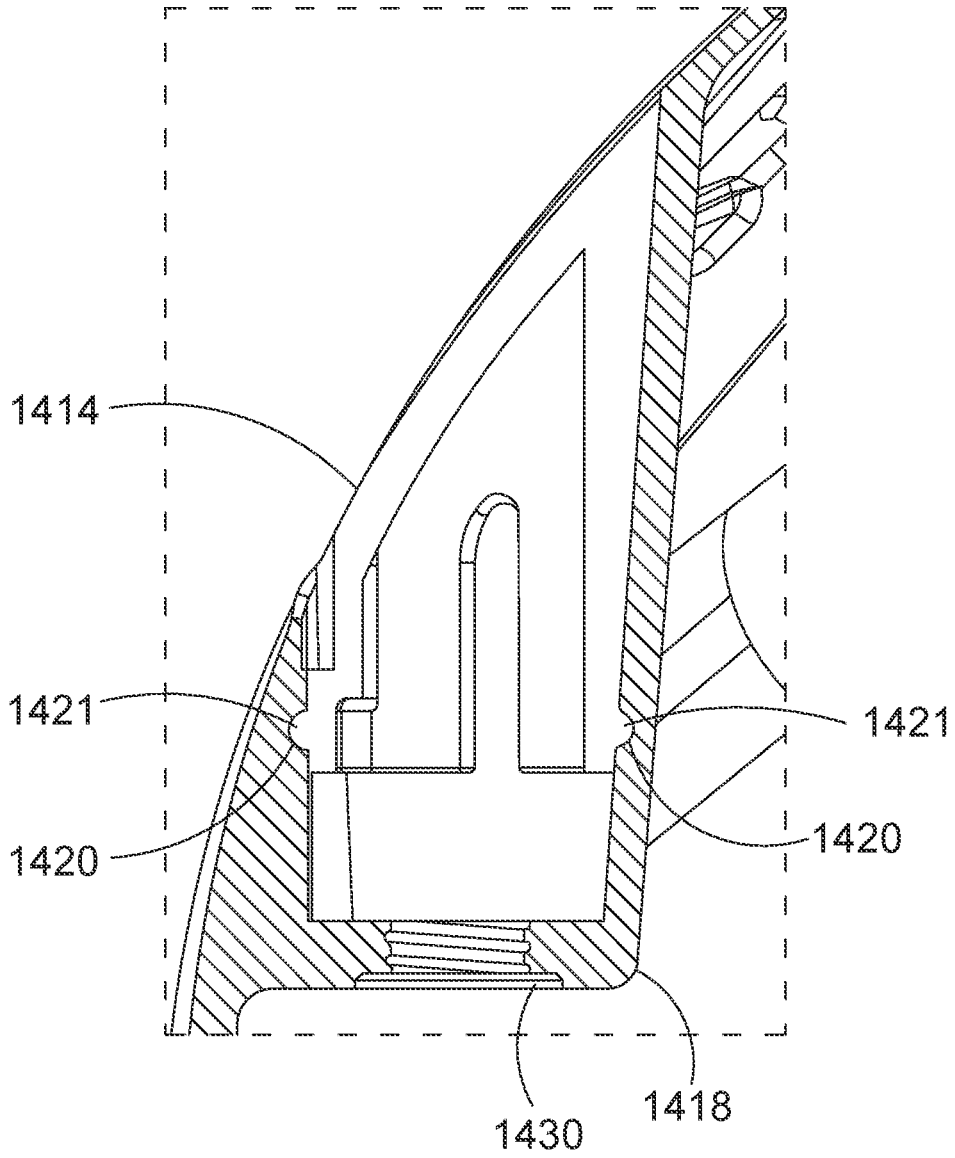
FIG. 14*c* of the accompanying drawings shows a partial cross-sectional view of a hosel region of a golf club head in accordance with an even further alternative embodiment of the present invention.

FIGS. 14*a* through 14*c* of the accompanying drawings shows a hosel portion 1410 of a golf club head in accordance with an even further alternative embodiment of the present invention. In this further alternative embodiment of the present invention, the hosel hole cover 1414 is secured to the hosel hole 1418 using one or more non-threaded protrusions 1421 located on the hosel hole cover 1414 to engage one or more non-threaded recessed undercuts 1420 located within the hosel hole 1418 to secure the hosel hole cover 1414 to the hosel hole 1418. The non-threaded protrusions 1421 in this embodiment differ from previous embodiments that incorporate this feature, as these protrusions do not move, and are not linked to a retention mechanism. Hence, in order to ensure the hosel hole cover 1414 stays within the hosel hole 1418, additional bonding agent such as glue may be added to enhance this bond without departing from the scope and content of the present invention. Finally, the receptacle opening 1425 in this embodiment, as previous discussion have already indicated, has the same surface area as previously discussed.

It should be noted that most of the embodiments discussed here aims to create a releasable hosel hole cover, however, all of these embodiments may include glue to make the hosel hole cover stay within the hosel hole, removing the ability to remove the hosel hoe cover without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a body portion comprising a crown portion, a sole portion, a heel portion, and a toe portion;

a hosel region located near a heel portion of said golf club head, said hosel region further comprising;

an upper end having a releasable hosel mechanism, a lower end having a hosel hole, and a hosel hole cover, adapted to engage said lower end of said hosel hole, said hosel hole cover further comprising a receptacle opening, said receptacle opening has a surface area of between about 55 $mm^2$ to about 300 $mm^2$.

2. The golf club head of claim 1, wherein said surface area of said receptacle opening has an area of between about 65 $mm^2$ to about 200 $mm^2$.

3. The golf club head of claim 2, wherein said surface area of said receptacle opening has an area of opening has an area of about 90 $mm^2$.

4. The golf club head of claim 1, further comprising;

a retention mechanism, adapted to secure said hosel cover to said golf club head.

5. The golf club head of claim 4, wherein said retention mechanism is a glue.

6. The golf club head of claim 4, further comprising;

a retention mechanism, adapted to secure said hosel hole cover to said golf club head, wherein said retention mechanism comprises one or more non-threaded protrusions, and wherein said one or more non-threaded protrusions are adapted to engage a one or more non-threaded recessed undercuts within said hosel hole to secure said hosel hole cover to said golf club head.

7. The golf club head of claim 6, wherein said retention mechanism is only adapted to rotate 90 degrees.

8. The golf club head of claim 6, wherein said rotation of said retention mechanism linearly moves one or more non-threaded protrusions with said one or more non-threaded recessed undercuts.

9. The golf club head of claim 8, wherein said retention mechanism is only adapted to rotate 90 degrees.

10. The golf club head of claim 6, wherein said hosel hole cover further comprises one or more attachment openings, said one or more attachment openings adapted to allow said one or more non-threaded protrusions to protrude out of said hosel cover.

11. The golf club head of claim 10, wherein said hosel hole cover further comprises two or more attachment openings and two or more non-threaded protrusions, said two or more attachment openings adapted to allow said two or more non-threaded protrusions to protrude out of said hosel hole cover.

12. The golf club head of claim 11, wherein said hosel cover further comprises three attachment openings and three non-threaded protrusions, said three attachment openings are adapted to allow said three non-threaded protrusions to protrude out of said hosel hole cover.

13. The golf club head of claim 12, wherein two of said three non-threaded protrusions have the same shape.

14. The golf club head of claim 6, wherein said hosel hole cover further comprises a male ledge at a bottom of said hosel hole cover, adapted to engage a female ledge located at a bottom of said hosel hole to retain said hosel hole cover to said hosel hole.

15. A golf club head comprising:

a body portion further comprising a crown portion, a sole portion, a heel portion, and toe portion;

a hosel region located near a heel portion of said golf club head, said hosel region further comprising:

an upper end having a releasable hosel mechanism, a lower end having a hosel hole, said hosel hole further comprising;

a one or more non-threaded recessed undercuts along a side wall of said hosel hole, a hosel hole cover, adapted to engage said hosel hole, and a retention mechanism, adapted to secure said hosel hole cover to said golf club head, wherein said retention mechanism comprises one or more non-threaded protrusions, and wherein a rotation of said retention mechanism rotatably engages said one or more non-threaded protrusions with said one or more non-threaded recessed undercuts.

16. The golf club head of claim 15, wherein said hosel hole cover further comprises a receptacle opening, adapted to receive said retention mechanism;

said receptacle opening has a surface area of between about 55 $mm^2$ to about 300 $mm^2$.

17. The golf club head of claim 16, wherein said surface area of said receptacle opening has an area of between about 65 $mm^2$ to about 200 $mm^2$.

18. The golf club head of claim 17, wherein said surface area of said receptacle opening has an area of opening has an area of about 90 $mm^2$.

* * * * *